US007664411B2

(12) United States Patent
Komiya

(10) Patent No.: US 7,664,411 B2
(45) Date of Patent: Feb. 16, 2010

(54) IMAGE FORMING APPARATUS INCLUDING IMAGE FORMATION ADJUSTMENT BASED ON PRIOR USE

(75) Inventor: Yoshiyuki Komiya, Abiko (JP)

(73) Assignee: Canon Kabushiki Kaisha (JP)

( * ) Notice: Subject to any disclaimer, the term of this patent is extended or adjusted under 35 U.S.C. 154(b) by 129 days.

(21) Appl. No.: 11/848,929

(22) Filed: Aug. 31, 2007

(65) Prior Publication Data

US 2008/0075484 A1 Mar. 27, 2008

(30) Foreign Application Priority Data

Sep. 26, 2006 (JP) ..... 2006-261412

(51) Int. Cl.
*G03G 15/01* (2006.01)

(52) U.S. Cl. ..... 399/38; 399/39; 399/46; 399/49; 399/53

(58) Field of Classification Search ..... 399/38–39, 399/46, 49, 53
See application file for complete search history.

(56) References Cited

U.S. PATENT DOCUMENTS

2005/0281573 A1 12/2005 Kitagawa et al.
2006/0263112 A1* 11/2006 Umetani et al. ..... 399/130

FOREIGN PATENT DOCUMENTS

JP 2003-091224 A 3/2003
JP 2003091224 A * 3/2003
JP 2004-101545 A 4/2004

OTHER PUBLICATIONS

Chinese Office Action dated Apr. 24, 2009 issued in corresponding CN Application No. 200710153102.7.

* cited by examiner

*Primary Examiner*—David M Gray
*Assistant Examiner*—G. M. Hyder
(74) *Attorney, Agent, or Firm*—Rossi, Kimms & McDowell LLP

(57) ABSTRACT

A technique of shortening the adjustment time of image forming conditions in accordance with the use status of each apparatus without degrading the image quality is disclosed. In a color image forming apparatus which has an adjustment unit that adjusts image forming parameters for setting image forming conditions, and which forms an image on a printing medium using the adjusted image forming parameters, the use log of the color image forming apparatus is collected, and at least one image forming parameter is selected in correspondence with the collected use log as an image forming parameter to be adjusted by the adjustment unit in next adjustment, by referring to a storage unit which stores, in correspondence with the use log, at least one image forming parameter to be adjusted by the adjustment unit.

20 Claims, 24 Drawing Sheets

FIG. 3

| | |
|---|---|
| SYSTEM PROGRAM (OS) | 301 |
| OPTIMUM CONTROL PATTERN DETERMINATION PROGRAM | 302 |
| VARIOUS CONTROL PROGRAMS (POTENTIAL CONTROL, MAXIMUM DENSITY CONTROL, TONE CORRECTION CONTROL, TONER DENSITY CONTROL, TRANSFER CONDITION OPTIMIZATION CONTROL, FORCED DEVELOPER DISCHARGE CONTROL, AND BLACK BAND FORMATION CONTROL) | 303 |
| TEST PATTERN PATCH PATTERN | 304 |
| OPTIMUM CONTROL PATTERN FOR EACH USE LOG | 305 |
| PARAMETERS NECESSARY FOR POTENTIAL CONTROL, MAXIMUM DENSITY CONTROL, TONE CORRECTION CONTROL, AND TONER DENSITY CONTROL | 306 |
| GRID POTENTIAL AND DEVELOPING BIAS POTENTIAL SET BY POTENTIAL CONTROL | 307 |
| PROPER CONTRAST POTENTIAL SERVING AS TARGET DENSITY CALCULATED BY MAXIMUM DENSITY CONTROL | 308 |
| TARGET VALUES OF FIRST AND SECOND TONE CONTROL PROCESSES USED IN TONE CORRECTION CONTROL, AND LUT CREATED BY FIRST AND SECOND TONE CONTROL PROCESSES | 309 |
| COUNTER VALUE OF MONOCHROME OUTPUT SHEET COUNT COUNTER VALUE OF FULL-COLOR OUTPUT SHEET COUNT DENSITY COUNTER VALUE OF OUTPUT IMAGE | 310 |
| MONOCHROME RATIO INFORMATION OUTPUT SHEET COUNT INFORMATION AVERAGE IMAGE DENSITY INFORMATION | 311 |
| ENVIRONMENTAL SENSOR (MOISTURE CONTENT) VALUE | 312 |
| PROGRAM LOAD AREA | 313 |
| ⋮ | |

FIG. 23 *Prior Art*
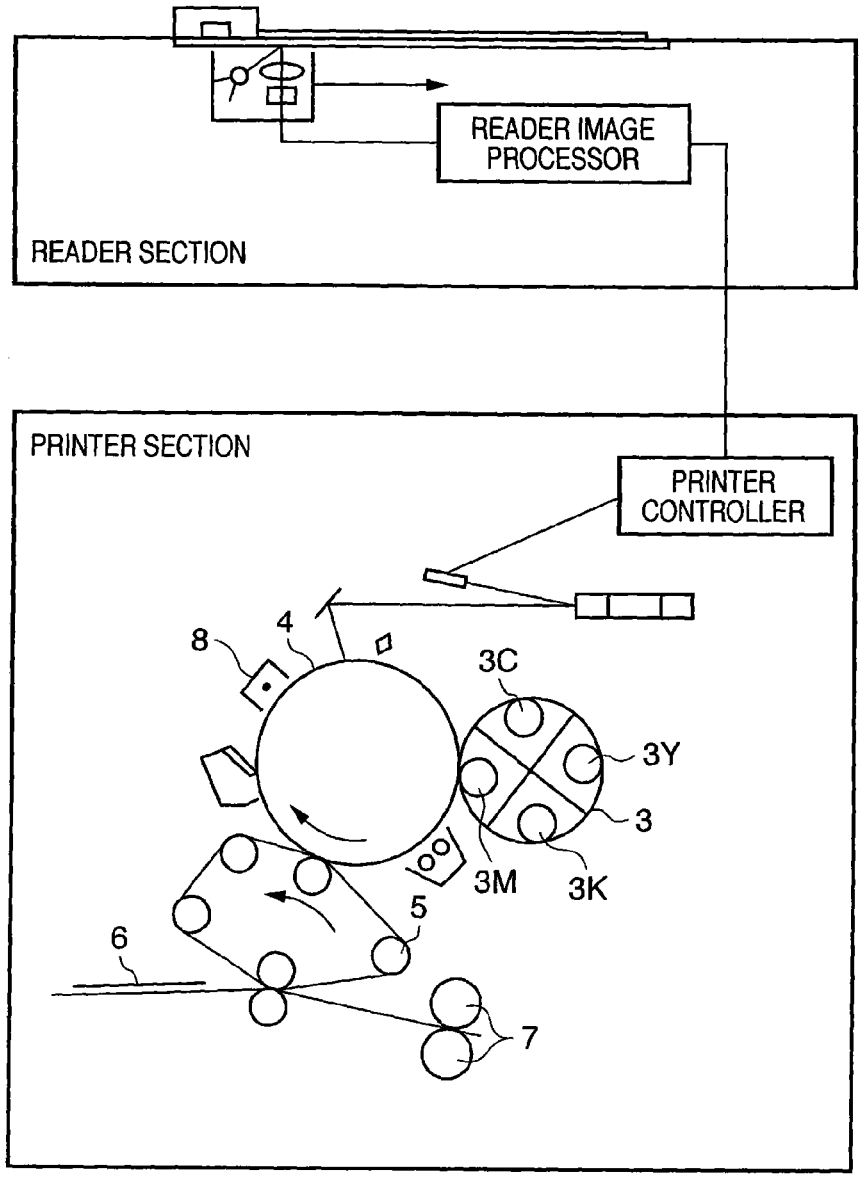

FIG. 24 *Prior Art*
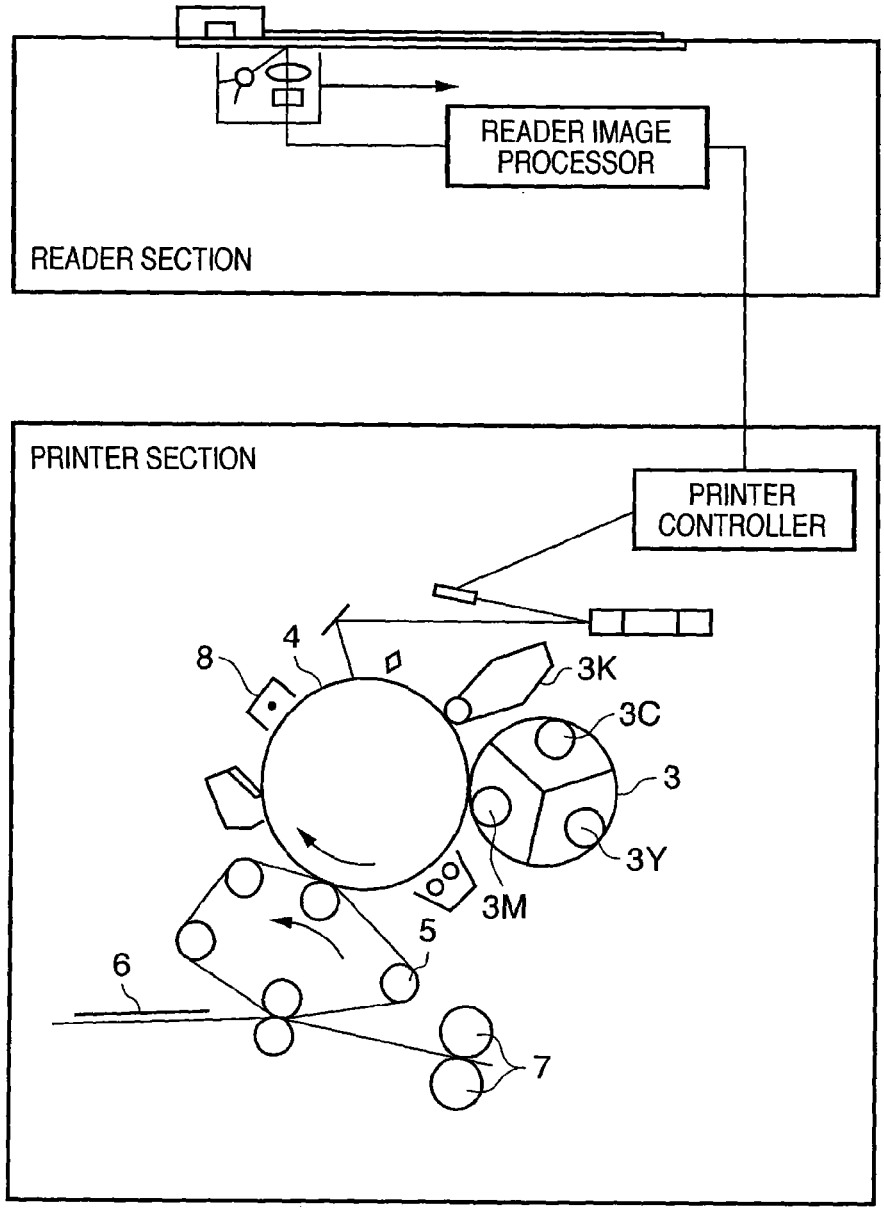

IMAGE FORMING APPARATUS INCLUDING IMAGE FORMATION ADJUSTMENT BASED ON PRIOR USE

BACKGROUND OF THE INVENTION

1. Field of the Invention

The present invention relates to a color image forming apparatus. The present invention relates to a color image forming apparatus of electrophotographic type, electrostatic printing type, or the like, an information processing apparatus, and a control method thereof and, more particularly, to an image formation adjusting technique in a color image forming apparatus.

2. Description of the Related Art

A color image forming apparatus such as that shown in FIG. 23 has conventionally been utilized. This color image forming apparatus adopts, as a developing means, a rotary developing device 3 having a magenta toner developing unit 3M, cyan toner developing unit 3C, yellow toner developing unit 3Y, and black toner developing unit 3K. The rotary developing device 3 is rotatably supported by a rotation support (not shown). The respective color toner developing units sequentially face a photosensitive drum 4 to develop an image with each color toner.

In this arrangement of the developing means, the photosensitive drum 4 is driven to rotate at a predetermined angular velocity, and its surface is uniformly charged by a charger 8. An electrostatic latent image of the first color (e.g., magenta) is formed on the photosensitive drum by scanning a laser beam ON/OFF-controlled in accordance with image data of the first color. The magenta toner developing unit 3M for the first color develops and visualizes the electrostatic latent image. The visualized first toner image is transferred onto an intermediate transfer member 5 driven to rotate in press contact with the photosensitive drum 4 at a predetermined press force. This process is repeated similarly for the second to fourth color toners (cyan, yellow, and black toners). Toner images of the color toners contained in the respective developing units are sequentially transferred and superposed on the intermediate transfer member 5, forming a color image. For a full-color image, images of the four color toners are transferred onto the intermediate transfer member 5 and then transferred at once onto a printing material 6 fed from a paper feed unit. The printing material 6 is discharged outside after the fixing process by a fixing unit 7, obtaining a full-color print.

Recently, higher monochrome output speeds are demanded of even full-color image forming apparatuses in order to cope with office use and the like.

To satisfy the market demand, there has also been devised a color image forming apparatus with an arrangement shown in FIG. 24. A developing means in FIG. 24 incorporates a rotary developing device 3 and fixed black toner developing unit 3K. The rotary developing device 3 contains a magenta toner developing unit 3M, yellow toner developing unit 3Y, and cyan toner developing unit 3C. The rotary developing device 3 is rotatably supported by a rotation support. For a full-color output, the color toner developing units 3M, 3Y, 3C, and 3K sequentially face a photosensitive drum 4 serving as an image carrier to develop an image with each color toner. For a monochrome output, development is done using the fixed developing unit 3K without using the rotary developing device 3. With the arrangement in FIG. 24, even a full-color image forming apparatus can obtain the same monochrome output throughput as that of a monochrome image forming apparatus. Since the black toner is generally consumed in a large amount for office use and the like, the adoption of the fixed black toner developing unit described above can increase its capacity.

These days, demands have arisen for introducing the above-mentioned electrophotographic copying machine and full-color printer into the office or the like. In this situation, the rise time (warm-up time) impairs user friendliness. The rise time is the time until the color image forming apparatus can actually print out (the color image forming apparatus stands by) after the main body is turned on. The time which occupies a large proportion of the rise time after power-on is the time necessary for temperature adjustment of the fixing unit and image adjustment.

An electrophotographic color image forming apparatus has often used a method of finally thermally fixing, onto a printing sheet, toner transferred onto the printing sheet. Thus, temperature control of the fixing unit is important. Stable temperature adjustment control at high temperatures is requested because color development and fixing are achieved by sufficiently fusing toners and mixing colors.

When the color image forming apparatus is turned on while the fixing unit is at low temperature after, e.g., left to stand, the temperature of the fixing roller must be raised within a short time, and the entire fixing roller must be adjusted to a uniform temperature. To meet these requirements, there has been proposed a technique of using a fixing roller material with high thermal conductivity or making the surface layer of the fixing roller thin. Another approach is the use of toner which easily fuses uniformly even at low temperature.

Recently, density stability and tone stability of an output image are required along with an increase in full-color outputs. To achieve them, the following methods have been known as image control methods for color image forming apparatuses such as an electrophotographic copying machine and printer.

For example, after a color image forming apparatus is activated and its warm-up operation ends, a specific pattern is formed and its pattern density is read. The operation of a circuit such as a γ correction circuit which determines image forming conditions is changed on the basis of the read density value, thereby stabilizing the quality of a formed image.

According to another method, a specific pattern is formed and read again even when the tone characteristic changes upon variations in environmental conditions. The read density value is fed back to a circuit such as a γ correction circuit which determines image forming conditions, thereby stabilizing the image quality against the variation of the environmental conditions.

After long-term use of a color image forming apparatus, the read density of a pattern on an image carrier may become different from the density of an actually printout image. To solve this, there is also known a method of forming a specific pattern on a printing material and correcting image forming conditions in accordance with the density value.

According to still another method, a specific pattern is formed in a non-image area during the image forming operation to read the pattern density. The operation of a circuit such as a γ correction circuit which determines image forming conditions is changed every image forming operation, thereby correcting ever-changing image characteristics at high precision.

However, a further decrease in rise time until the standby state after power-on is an important factor in recent color image forming apparatuses.

Especially, a user who wants to output a monochrome image or a business document or the like, which does not put importance on tonality, immediately after power-on requires a color image forming apparatus with a short rise time till the standby state after power-on. As described above, the color image forming apparatus executes the temperature adjustment operation of the fixing unit after power-on and the image adjustment operation after the end of the warm-up operation. To shorten the rise time, there is proposed a method of executing these two operations at the same time. However, this method is unpreferable because it requires a large power amount and goes against recent trend toward energy saving.

Also, the following problems arise when a color image forming apparatus is used in the office where monochrome outputs occupy most of the outputs. That is, every time the color image forming apparatus is turned on, it must execute image control including density control and tone control to stabilize a full-color output image, though the output frequency of full-color images is low. The color image forming apparatus must execute full-color image control at intervals of a predetermined sheet count during monochrome output.

To solve these problems, the default image control settings and image control interval of a color image forming apparatus may be set in accordance with monochrome output. In this case, however, the full-color image control frequency is minimized, and the density and tone stabilities of full-color images cannot be assured for a user who frequently outputs full-color images. However, settings suited to full-color output decrease the throughput, and cannot satisfy a user who outputs many monochrome images. It is, therefore, difficult to make the default image control settings of all office-use color image forming apparatuses in different use environments.

Some of the above-described full-color image forming apparatuses employ a developing unit using a two-component developer containing a magnetic carrier and nonmagnetic carrier. In this case, for example, when low-density images are formed successively, degraded toner is discharged, or toner is applied into a band shape and used as a lubricant for the cleaner. However, in a full-color image forming apparatus used mainly for monochrome output, toner is consumed every time this control is executed, though color output is rare.

To solve this problem, a serviceman checks the use status of each user's full-color image forming apparatus, and designates an optimum control form matching the use environment of a user for each full-color image forming apparatus in accordance with the check result, optimizing each full-color image forming apparatus. For example, the serviceman checks the ratio of monochrome outputs and full-color outputs and the number of output sheets per predetermined period. Further, the serviceman adjusts, e.g., the density/tone correction control interval which starts as the down sequence during continuous output on the basis of use requirements from a user.

In this conventional practice, a serviceman must go to the location where each full-color image forming apparatus is installed, collect pieces of information, and set the full-color image forming apparatus.

To eliminate serviceman's trouble, there is proposed a system which allows a maintenance personnel at a remote place to obtain output sheet count information and use location environment information from a color image forming apparatus via a network, and to provide optimum parts and optimum setting values to a user on the basis of the obtained pieces of information (see, e.g., patent reference 1).

[Patent Reference 1] Japanese Patent Laid-Open No. 2004-101545

According to this arrangement, the serviceman grasps the environment of the use location of a color image forming apparatus and the number of output sheets by a user from a remote place using a network without visiting the user's office, and provides optimum parts and setting values. This can eliminate serviceman's trouble and greatly reduce labor costs. However, this arrangement cannot satisfy the above-mentioned purpose to optimize a color image forming apparatus in accordance with the use form of each user. In particular, this arrangement can achieve neither optimization of activation conditions corresponding to the use status such as the ratio of monochrome outputs and full-color outputs, nor an increase in throughput during continuous output. These demands arise from most users who use full-color image forming apparatuses in the office.

In addition, this arrangement requires the intervention of a maintenance personnel when providing optimum parts and setting values in accordance with obtained information. From this viewpoint, this arrangement is considered an extension of a conventional service which requires a serviceman to visit each user's office and optimize each full-color image forming apparatus.

SUMMARY OF THE INVENTION

The present invention enables shortening the adjustment time of image forming conditions in accordance with the use status of each apparatus without degrading the image quality.

According to one aspect of the present invention, the foregoing problem is solved by providing an image forming apparatus comprising an image forming unit adapted to form an image, a storage unit adapted to store a ratio of monochrome images to color images formed by the image forming unit, a selection unit adapted to select a desired adjustment operation from a plurality of adjustment operations for adjusting the image forming unit and an adjustment unit adapted to, when activating the image forming apparatus, selectively perform, on the basis of the ratio of monochrome images to color images that is stored in the storage unit, a desired adjustment operation from a plurality of adjustment operations for adjusting the image forming unit.

According to another aspect of the present invention, the foregoing problem is solved by providing an image forming apparatus comprising an image forming unit adapted to form an image, a storage unit adapted to store a ratio of monochrome images to color images formed by the image forming unit, and density information of the color images and monochrome images, a selection unit adapted to select a desired adjustment operation from a plurality of adjustment operations for adjusting the image forming unit and an adjustment unit adapted to, when adjusting the image forming unit, selectively perform, on the basis of the ratio of monochrome images to color images and the density information that are stored in the storage unit, a desired adjustment operation from a plurality of adjustment operations for adjusting the image forming unit.

Further features of the present invention will be apparent from the following description of exemplary embodiments with reference to the attached drawings.

BRIEF DESCRIPTION OF THE DRAWINGS

FIG. 3 is a view showing structures of a ROM and RAM;

FIG. 23 is a sectional view showing a conventional image forming apparatus; and FIG. 24 is a sectional view showing another conventional image forming apparatus.

DESCRIPTION OF THE EMBODIMENTS

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

[Features]

An image forming apparatus according to the first embodiment can change the items of image forming conditions adjusted upon activation or the like in accordance with the use status of the apparatus. When the output ratio of monochrome images is high and the output frequency of color images is low in the office or the like, the image forming apparatus can shorten the time of adjustment upon power-on to maintain color output images at high quality. Use status information (use log) includes the monochrome image ratio out of monochrome and color images formed after previous adjustment of image forming conditions, the total number of images, and the average image density of all images. The image forming apparatus can collect the use log when forming an image after previous adjustment of image forming conditions. The image forming apparatus can also store the adjustment items of necessary image forming conditions in a storage means in correspondence with each use log. The adjustment items include potential control, maximum density control, tone correction control, and toner density control. The image forming apparatus can limit adjustment of image forming conditions to adjustment items necessary to maintain high image quality, and can omit unnecessary adjustment on the basis of the use log. Hence, the image forming apparatus can shorten the rise time till the standby state after activation. For example, when the image forming apparatus is used mainly to output monochrome images after previous setting of image forming conditions, next adjustment of image forming conditions can be limited to only adjustment item necessary to output high-quality monochrome images. As a result, adjustment of adjustment items necessary to output high-quality color images can be omitted. The image forming apparatus according to the first embodiment will be explained below. Note that features of the present invention are shown in FIGS. 17 to 20.

Figure 1:
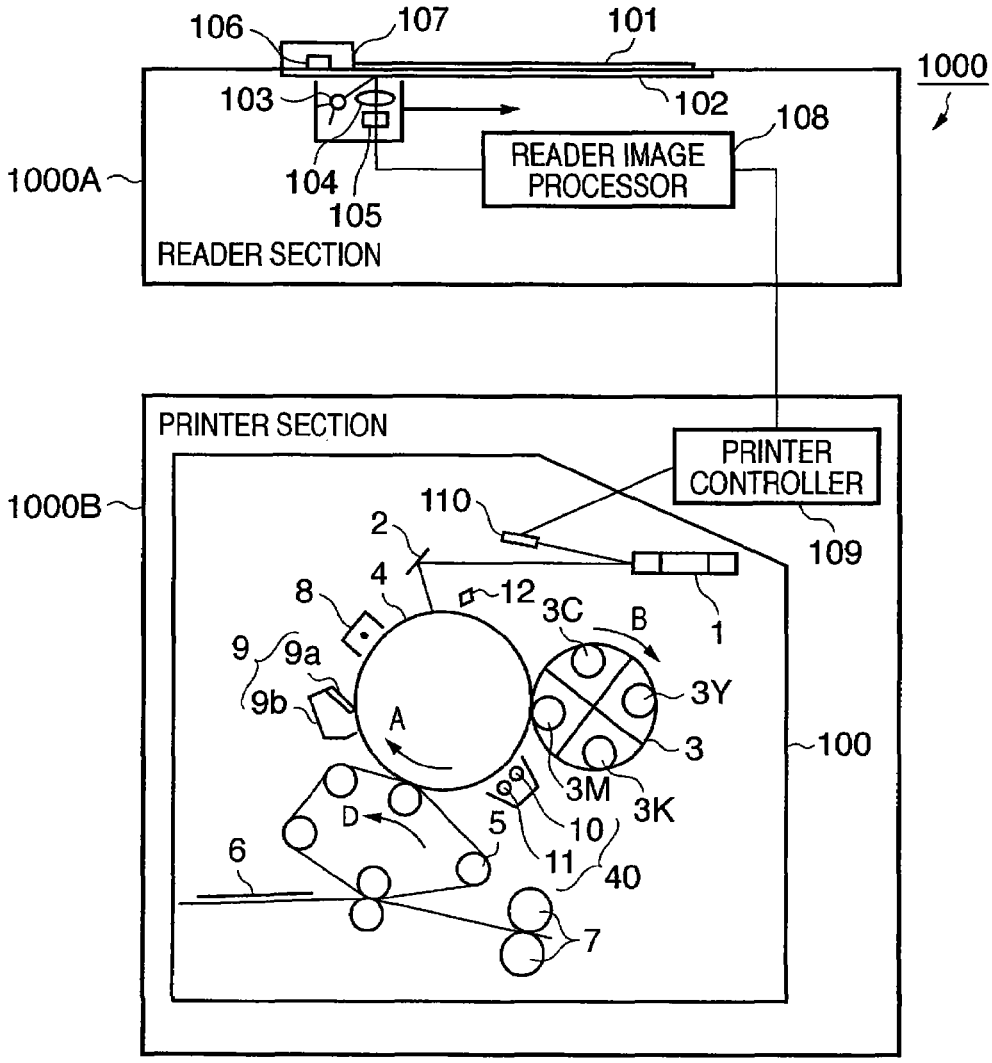
FIG. 1 is a sectional view showing an overall arrangement of an image forming apparatus according to the first embodiment.

[Overall Arrangement of Image Forming Apparatus: FIG. 1]

FIG. 1 is a sectional view showing an image forming apparatus 1000 according to the first embodiment.

The image forming apparatus 1000 mainly comprises a reader section 1000A, printer section 1000B, and operation unit (not shown). The reader section 1000A reads image data, and the printer section 1000B outputs image data. The operation unit comprises a keyboard to input/output image data, and a liquid crystal panel to display image data and various functions.

The reader section 1000A will be described first.

The reader section 1000A comprises a document feed unit which conveys a document sheet, and a scanner unit which optically scans a document image and converts it into image data serving as an electrical signal. The reader section 1000A optically reads a document image and converts it into image data serving as an electrical signal. The reader section 1000A is mounted on the printer section 1000B. In the reader section 1000A, document sheets stacked on a document feed unit 101 are fed onto a platen glass 102 one by one sequentially from the first sheet in the stacking order. After the end of a predetermined scanning operation by the scanner unit, the scanned document sheet is discharged from the platen glass 102 to the document feed unit 101.

In the scanner unit, when a document sheet is conveyed onto the platen glass 102, a lamp 103 is turned on. Then, the optical unit starts moving, and irradiates and scans the document sheet from below it. Reflected light from the document sheet is guided to a CCD image sensor (to be simply referred to as a "CCD" hereinafter) 105 via a plurality of mirrors and a lens 104. The CCD 105 reads the scanned document image.

A reader image processor 108 performs a predetermined process for the image data obtained by the CCD 105, and transfers the processed data to a printer controller 109 in the printer section 1000B.

Next, the printer section 1000B will be explained.

In FIG. 1, a charging means 8 is a corona charger, and applies a bias to uniformly charge the surface of a photosensitive drum 4 negatively. Image data is converted into a laser beam via a laser driver 27 (see FIG. 2) incorporated in the printer controller 109 and a laser source 110. The laser beam is reflected by a polygon mirror 1 and mirror 2 to irradiate the uniformly charged photosensitive drum 4. The photosensitive drum 4 bearing a latent image as a result of laser beam scanning rotates in a direction indicated by arrow A shown in FIG. 1.

A switching type rotary developing means 3 comprises a magenta toner developing unit 3M, yellow toner developing unit 3Y, cyan toner developing unit 3C, and black toner developing unit 3K. In the first embodiment, the developer is a two-component developer containing a magnetic carrier and nonmagnetic carrier. A rotation support 3*a* (not shown) supports the rotary developing means 3 rotatably in a direction indicated by arrow B in FIG. 1. The color toner developing units 3M, 3Y, 3C, and 3K sequentially rotate and move to a position where they face the photosensitive drum 4, developing an image with each color toner. In this arrangement of the developing means, the corona charger 8 uniformly charges the surface of the photosensitive drum 4 (to −500 V in the first embodiment).

An electrostatic latent image (about −150 V in the first embodiment) of the first color (e.g., magenta) is formed on the photosensitive drum 4 by exposure scanning by an exposure means ON/OFF-controlled in accordance with image data of the first color. The magenta toner developing unit 3M containing magenta toner (negative polarity) as the first color develops and visualizes the electrostatic latent image of the first color. The visualized toner image of the first color is pressed against the photosensitive drum 4 at a predetermined press force. The visualized toner image of the first color is primarily transferred onto an intermediate transfer member 5 at the nip between the photosensitive drum 4 and the intermediate transfer member 5 driven to rotate in a direction indicated by arrow D at almost the same speed (273 mm/s in the first embodiment) as the peripheral speed of the photosensitive drum 4.

Toner left on the photosensitive drum 4 without being transferred to the intermediate transfer member 5 in the primary transfer process is scraped by a cleaning blade 9*a* of a cleaning means 9 in press contact with the photosensitive drum 4, and recovered to a waste toner vessel 9*b*.

The above-described primary transfer process is repeated similarly for the remaining toners (cyan, yellow, and black toners). Toner images of the different color toners contained in the respective developing units are sequentially transferred and superposed on the intermediate transfer member 5. The superposed toner images are secondarily transferred at once onto a printing material 6 fed from a paper feed unit. The printing material 6 is discharged outside after the fixing process by a fixing unit 7, obtaining a full-color print.

The image forming apparatus of the first embodiment comprises a photo-sensor 40 including an LED light source 10 (with a domain wavelength of about 960 nm) and a photodiode 11 in order to detect the reflected light quantity of a toner patch pattern formed on the photosensitive drum 4.

Figure 2:
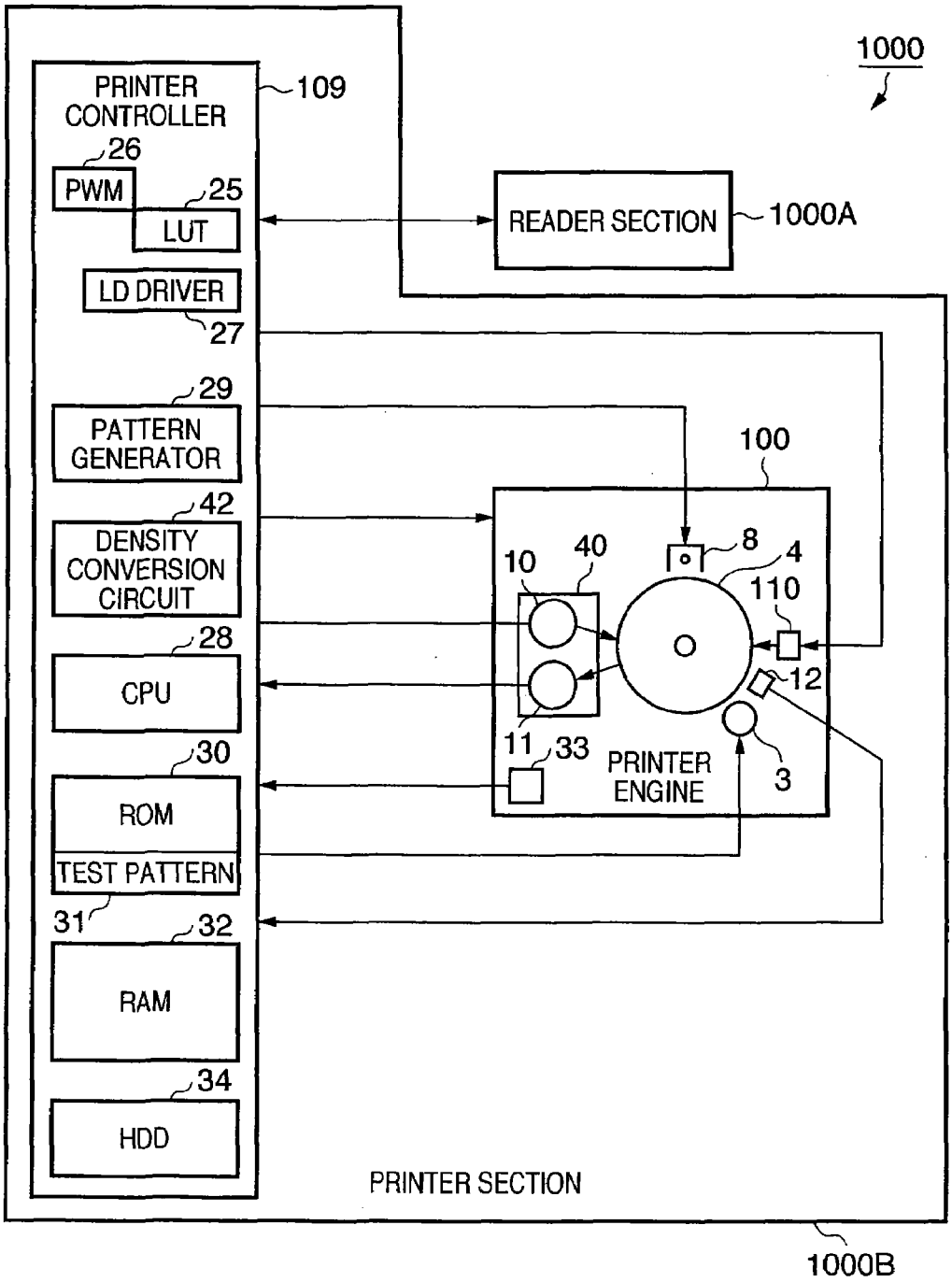
FIG. 2 is a block diagram showing the control arrangement of the image forming apparatus.

[Control Arrangement of Image Forming Apparatus: FIG. 2]

FIG. 2 is a block diagram showing the control arrangement of the image forming apparatus 1000 according to the first embodiment.

The printer controller 109 comprises a CPU 28, a test pattern 31, a ROM 30 which stores control programs and the like, a RAM 32, a density conversion circuit 42, a pattern generator 29, an LD driver 27, a PWM 26, and a LUT 25. The printer controller 109 can communicate with a printer engine 100. The CPU 28 executes various processes by controlling respective units using the RAM 32 as a work area on the basis of the control programs stored in the ROM 30. This process includes a process to determine a control pattern (adjustment items of image forming conditions) optimum for image stabilization on the basis of the use log (to be described later).

The printer engine 100 controls the photosensor 40 arranged around the photosensitive drum 4 and including the LED 10 and photodiode 11, the primary charger 8, the laser source 110, a surface potential sensor 12, the developing device 3, and an environmental sensor 33. The environmental sensor 33 measures the moisture content in air inside the apparatus. The surface potential sensor 12 is arranged upstream of the developing device 3. The CPU 28 controls the grid potential of the primary charger 8 and the developing bias of the developing device 3, which will be described later.

[Structures of ROM and RAM: FIG. 3]

FIG. 3 is a view showing structures of the ROM 30 and RAM 32. FIG. 3 illustrates programs and data related to the embodiment, and does not illustrate general or less related ones.

In the ROM 30, a system program is stored in an area 301, and an optimum control pattern determination program is stored in an area 302. A variety of control programs for potential control, maximum density control, tone correction control, toner density control, transfer condition optimization control, forced developer discharge control, and black band forming control are stored in an area 303. A test pattern and image formation patch pattern are stored in an area 304, and an optimum control pattern (see FIGS. 19 and 20) for each use log is stored in an area 305. Each use log includes conditions determined by the combination of the monochrome ratio and total output sheet count, and conditions determined by the combination of the monochrome ratio, average image density, and total output sheet count. Parameters necessary for potential control, maximum density control, tone correction control, and toner density control are stored in an area 306. Parameters necessary for potential control are, e.g., the correction coefficient Ka, the target image density, the maximum image density DA, and a correction coefficient Vcont.ratel for correcting a contrast potential. In the RAM 32, a grid potential and developing bias potential set by potential control are stored in an area 307, and a proper contrast potential serving as a target density calculated by maximum density control is stored in an area 308. The target values of the first and second tone control processes used in tone correction control, and a created LUT are stored in an area 309.

The counter value of a monochrome output sheet count, that of a full-color output sheet count, and that of the average image density of output images are stored in an area 310. Monochrome ratio information, output sheet count information, and average image density information collected and calculated on the basis of the counter values are stored in an area 311, and used as a use log. The measurement value of the environmental sensor (moisture content) and the like are stored in an area 312. A program load area 313 is also prepared in the RAM 32.

Figure 4:
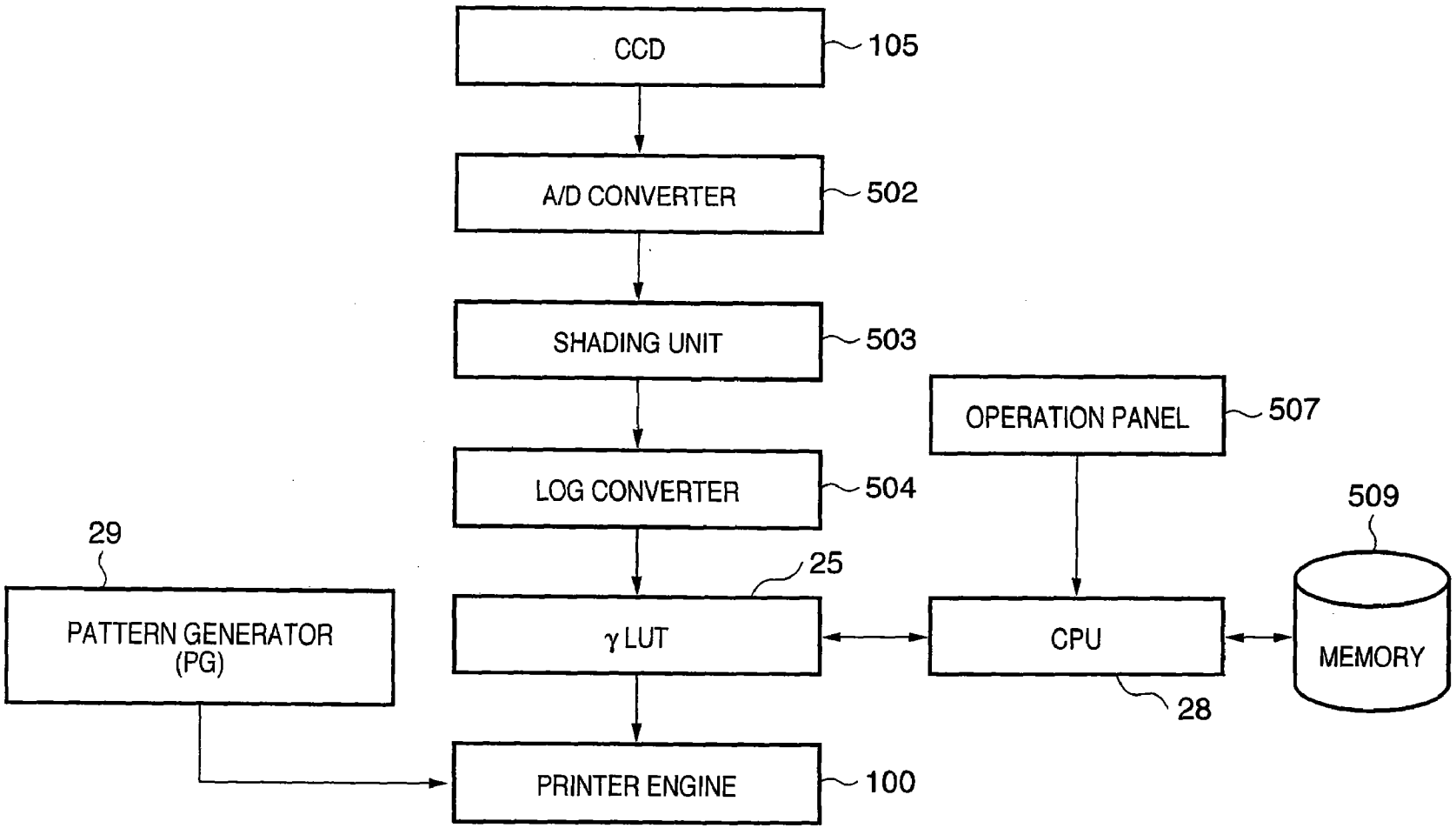
FIG. 4 is a block diagram for explaining an image signal process.

[Image Signal Process in Reader Section: FIG. 4]

An image signal process in the image forming apparatus 1000 will be explained with reference to FIG. 4.

The luminance signal of a document image read by the CCD 105 (see FIG. 1) is input to an A/D converter 502 and converted into a digital signal. The digital luminance signal is supplied to a shading unit 503 of the reader image processor 108 where illumination non-uniformity caused by variations between the sensitivities of CCD elements undergoes shading correction. Shading correction improves the measurement reproducibility of the CCD 105. The luminance signal corrected by the shading unit 503 is LOG-converted by a LOG converter 504. The LOG-converted signal is supplied to the γLUT 25 (see FIG. 4) of the printer controller 109 where the image signal is converted so that an output image density characteristic processed in accordance with the γ characteristic matches the ideal density characteristic of the image forming apparatus. The converted image signal is transmitted to the printer engine 100 (see FIG. 1) to form an image.

Figure 5:
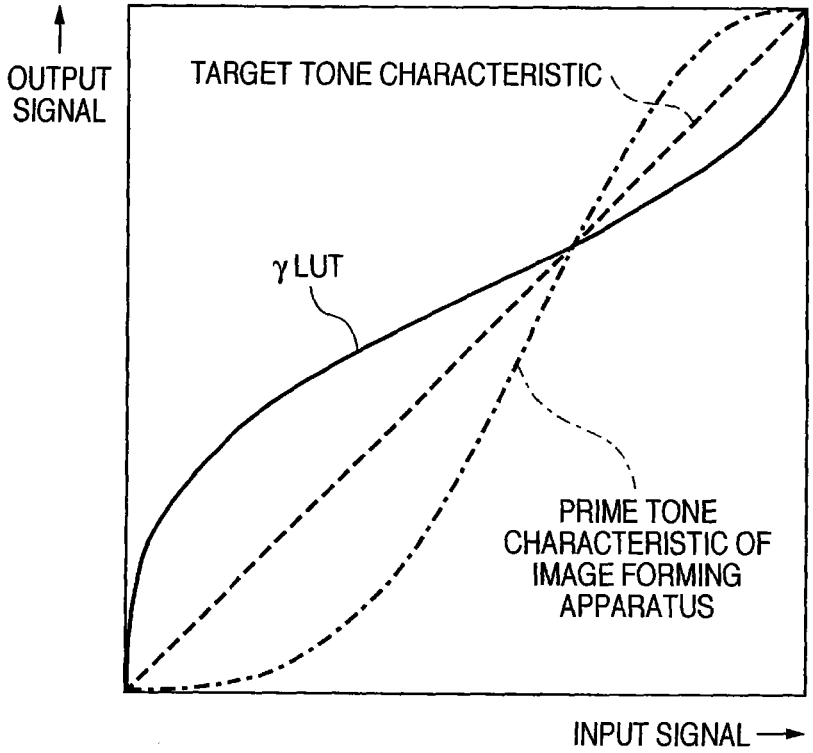
FIG. 5 is a graph for explaining a method of creating a γLUT.

[Conversion of Prime Tone Characteristic of Image Forming Apparatus into Target Tone Characteristic: FIG. 5]

The above-mentioned image signal conversion will be described with reference to FIG. 5.

FIG. 5 shows the relationship between a characteristic obtained by converting a signal read by the CDD into a density signal, an ideal target tone characteristic set in advance in the image forming apparatus, and a γLUT characteristic generated to convert the prime tone characteristic of the image forming apparatus into the ideal target tone characteristic. The prime tone characteristic of the image forming apparatus is a tone characteristic obtained by converting a signal read by the CDD into a density signal. As shown in FIG. 5, the prime tone characteristic of the image forming apparatus can be converted into a target tone characteristic using the generated γLUT.

Figure 6:
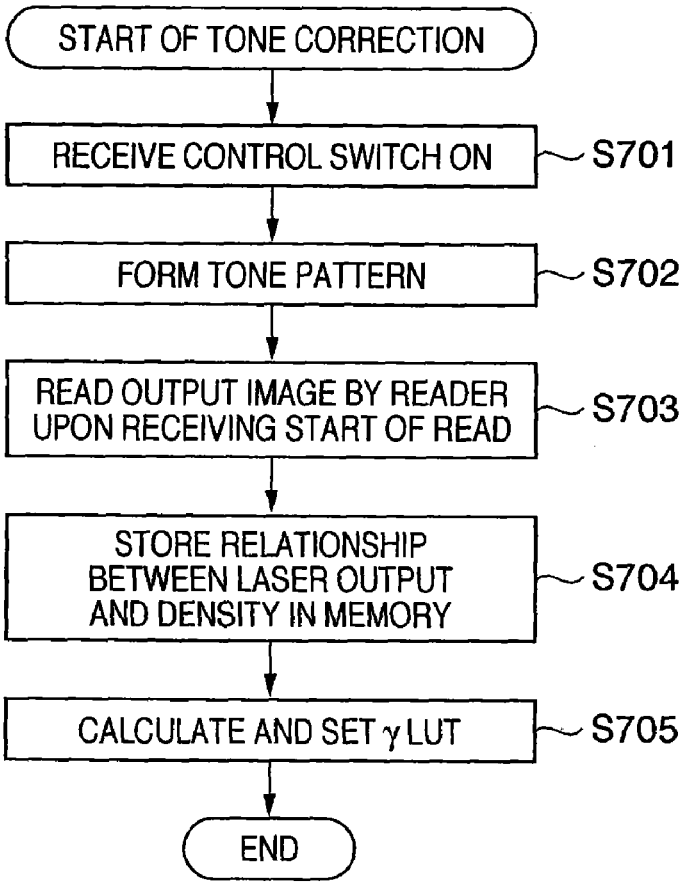
FIG. 6 is a flowchart showing a tone correction process.

[γLUT Setting Method: FIG. 6]

The above-mentioned γLUT setting method will be described with reference to FIG. 6.

That is, calculation and setting of the γLUT in the first tone control using the reader section 1000A according to the first embodiment will be explained with reference to FIG. 6. The CPU 28 executes the following process by controlling respective units using the RAM 32 as a work area on the basis of control programs stored in the ROM 30.

If the CPU 28 detects in step S701 of FIG. 6 that the user has pressed a start switch for the tone correction process, the process advances to step S702.

Figure 7:
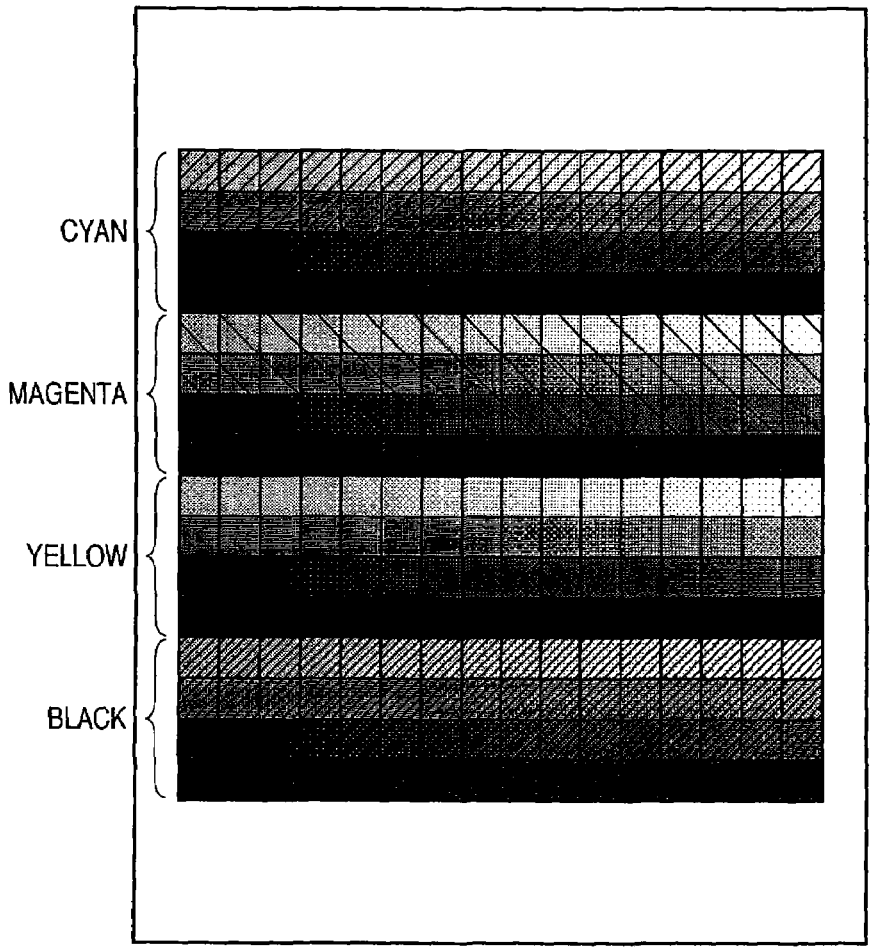
FIG. 7 is a view showing an example of a tone pattern used in the tone correction process.

In step S702, the CPU 28 instructs the printer engine 100 to form and output a tone test pattern generated by the pattern generator (PG) 29 (see FIGS. 2 and 4) at 64 gray levels in each of four, magenta, yellow, cyan, and black colors. FIG. 7 shows an example of an output tone test pattern formed on a printing material by the printer engine 100.

Figure 8:
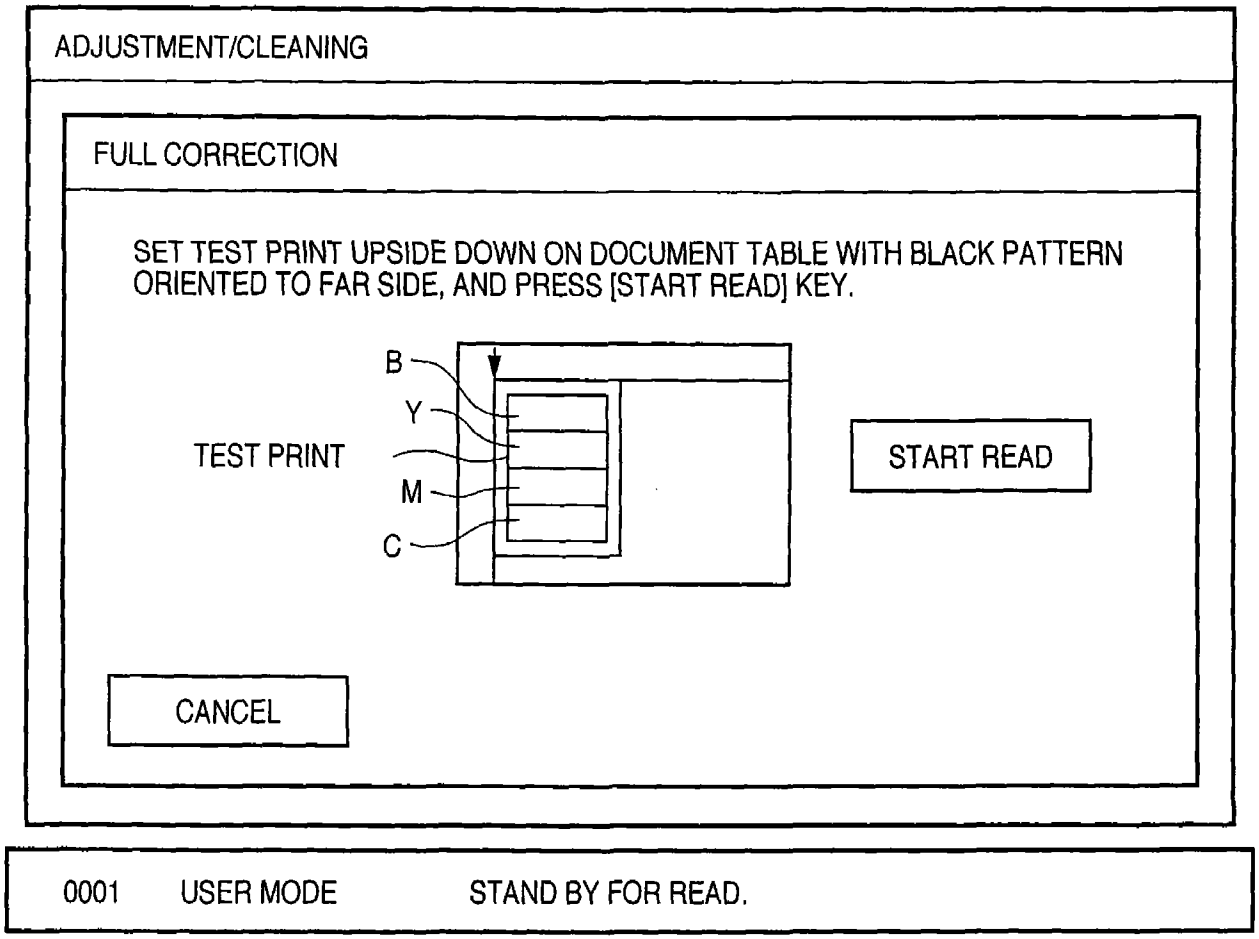
FIG. 8 is a view showing an example of an operation panel.

If the CPU 28 detects in step S703 that the user has set the output tone test pattern on the reader section 1000A and has pressed the read button, it reads the tone test pattern and causes the CCD 105 to convert it into a light quantity signal. Then, the CPU 28 LOG-converts the data converted into the light quantity signal by the CCD 105, and stores the converted data as read density data. FIG. 8 shows an example of a window displayed on an operation panel 507 (see FIG. 4).

In step S704, the CPU 28 obtains the relationship between the read density data and a laser output level attained when the tone test pattern is created, and stores the relationship in a memory 509.

In step S705, the CPU 28 generates a γLUT on the basis of the relationship between the laser output level and the read density, and the relationship (see FIG. 5) between the laser output level and the ideal target characteristic of the image forming apparatus. The CPU 28 controls to hold the generated γLUT in the γLUT 25. This process is calculation and setting of the γLUT in the first tone control.

Control methods for potential control, maximum density adjustment, tone correction, and toner density control in the image forming apparatus 1000 will be described in detail.

<A. Potential Control>

Figure 9:
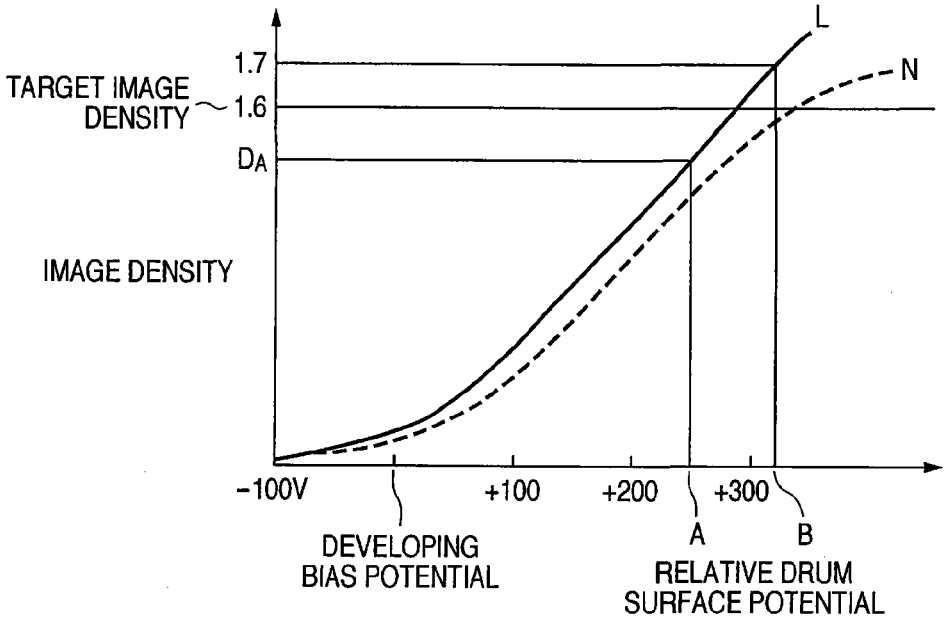
FIG. 9 is a graph showing the relationship between the relative drum surface potential and the image density.

[Relationship Between Relative Drum Surface Potential and Image Density: FIG. 9]

A potential control method in the image forming apparatus 1000 will be explained.

FIG. 9 shows a relationship between the relative drum surface potential and an image density obtained by the above-described calculation.

As shown in FIG. 9, assume that the obtained maximum image density is DA at a setting at which A represents the difference between a contrast potential used at that time, i.e., developing bias potential, and the surface potential of the photosensitive drum when the surface potential reaches the maximum level in the use of a laser beam after primary charging. In this case, as indicated by a solid line L in FIG. 9, the image density often linearly corresponds to the relative drum surface potential in the density range of the maximum image density (the image density increases as the relative drum surface potential increases). In a two-component developing system, however, if the toner density in the developing unit varies and drops, the image density may exhibit a non-linear characteristic in the maximum density range, as indicated by a broken line N in FIG. 9.

In the first embodiment, the final target value of the maximum image density is set to 1.6. However, the controlled variable is determined by setting the target control value of the maximum image density to 1.7 including a 0.1 margin in consideration of variations in toner density. A contrast potential B in this case is given by $B=(A+Ka)\times 1.7/DA$ . . . (1) where Ka is the correction coefficient whose value is preferably optimized in accordance with the developing method, and DA is an obtained maximum image density.

Figure 10:
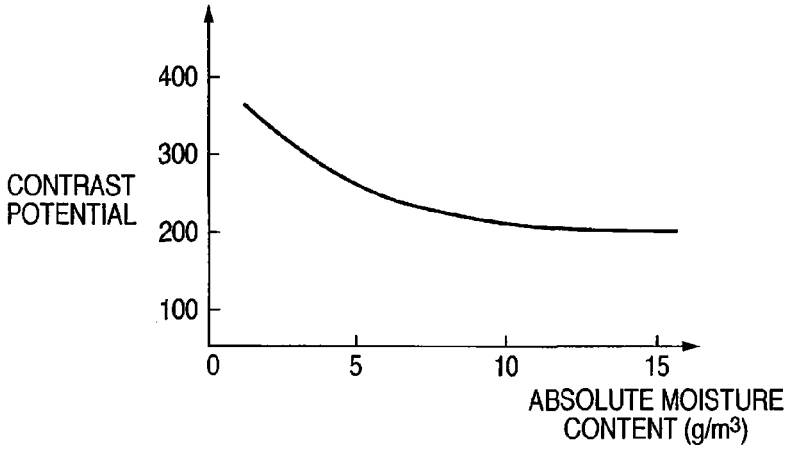
FIG. 10 is a graph showing the relationship between the absolute moisture content and the contrast potential.

[Correction of Contrast Potential: FIG. 10]

The contrast potential B can be calculated by equation (1). In practice, however, the image density may lose correspondence with the relative drum surface potential in electrophotographic printing unless the setting of the contrast potential A is changed in accordance with the environment. The setting of the contrast potential must be changed as shown in FIG. 10 in accordance with an output from the environmental sensor 33 which monitors the moisture content inside the apparatus, as described above. As a method of correcting the contrast potential, according to the first embodiment, the correction coefficient Vcont.ratel given by equation (2) is saved in the backup RAM: Vcont.ratel=B/A . . . (2)

In the image forming apparatus, the environmental sensor 33 monitors transition of the environment (moisture content) every 30 min. Every time the value A is determined on the basis of the determination result, A×Vcont.rate1 (=B) is calculated to obtain the contrast potential B.

Figure 11:
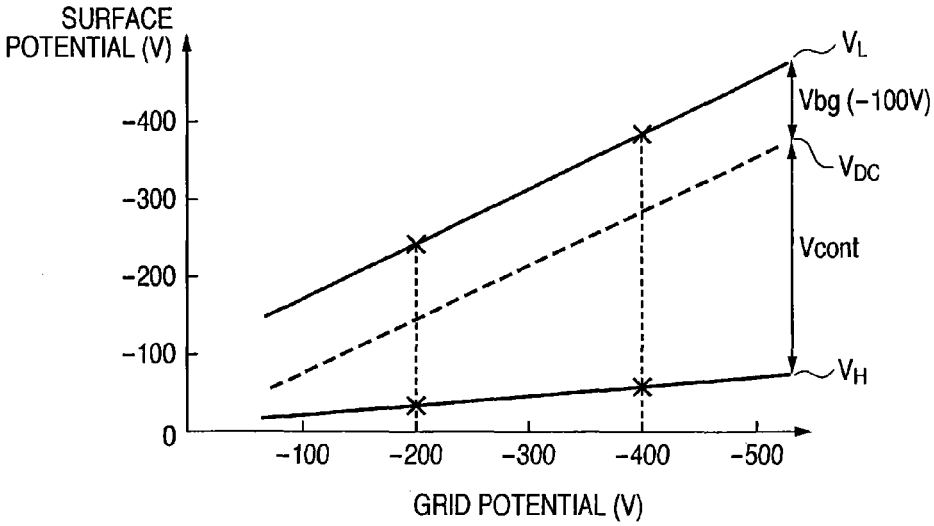
FIG. 11 is a graph showing the relationship between the grid potential and the surface potential.

[Calculation of Grid Potential and Developing Bias Potential: FIG. 11]

An example of a method of calculating a grid potential and developing bias potential from an obtained contrast potential will be explained with reference to FIG. 11.

FIG. 11 is a graph showing the relationship between the grid potential and the surface potential of the photosensitive drum.

In the first embodiment, the surface potential sensor 12 measures a surface potential $V_{L1}$ upon scanning when the grid potential is set to −200 V and the laser beam level is minimized, and a surface potential $V_{H1}$ when the laser level beam is maximized. Similarly, the surface potential sensor 12 measures a surface potential $V_{L2}$ upon scanning when the grid potential is set to −400 V and the laser beam level is minimized, and a surface potential $V_{H2}$ when the laser beam level is maximized. Then, data (surface potentials $V_{L1}$ and $V_{H1}$) at −200 V and data (surface potentials $V_{L2}$ and $V_{H2}$) at −400 V are interpolated and extrapolated, obtaining the relationship between the grid potential and the surface potential shown in FIG. 11. Control to obtain potential data is called potential measurement control.

A developing bias $V_{DC}$ is set by setting a difference Vbg (100 V in this case) from $V_L$ so as to prevent attachment of fog toner to an image. A contrast potential Vcont is the difference voltage between the developing bias $V_{DC}$ and $V_H$. As Vcont is higher, a higher maximum density can be attained.

The magnitudes of the grid potential and developing bias potential necessary to adjust the contrast potential Vcont to the calculated contrast potential B can be calculated from the relationship shown in FIG. 11. The CPU 28 can set the grid potential and developing bias potential to attain a target contrast potential.

<B. Maximum Density Control>

A maximum density control method in the image forming apparatus 1000 will be explained.

The image forming apparatus 1000 controls the maximum density to an optimum one by finely adjusting a contrast potential obtained in the above-mentioned potential control to a contrast potential obtained from density data of a predetermined toner patch detected by the photosensor 40.

The maximum density control method will be described with reference to FIGS. 12 to 15.

Figure 12:
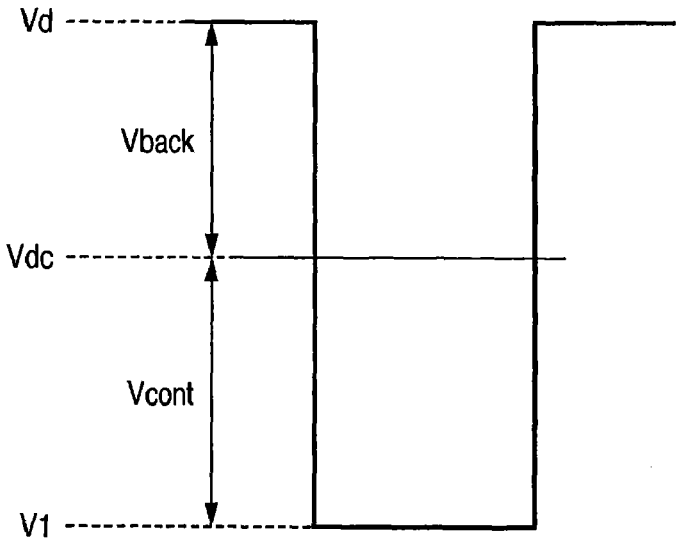
FIG. 12 is a chart for explaining the contrast potential.

[Contrast Potential: FIG. 12]

A reference Contrast potential Vcont0 is attained as a result of the potential control. The contrast potential Vcont is the difference voltage between a developing bias Vdc and a surface potential V1 of the exposed photosensitive drum, as shown in FIG. 12. As Vcont is higher, the maximum image density is higher. The difference voltage between the developing bias Vdc and a surface potential (potential in the dark) Vd of the charged photosensitive drum is called a defogging potential Vback.

[Formation of Toner Patch: A in FIG. 13]

A plurality of toner patches are formed at predetermined potential widths (25 V each in the first embodiment) centered on the reference contrast potential Vcont0 obtained by potential control. In the first embodiment, as shown in A of FIG. 13, five toner patches are formed at a maximum signal value of 255 levels using a total of five contrast potentials Vcont0−50 V, Vcont0−25 V, Vcont0, Vcont0+25 V, and Vcont0+50 V. The photosensor 40 facing the photosensitive drum 4 detects the densities of the toner patches.

Figure 14:
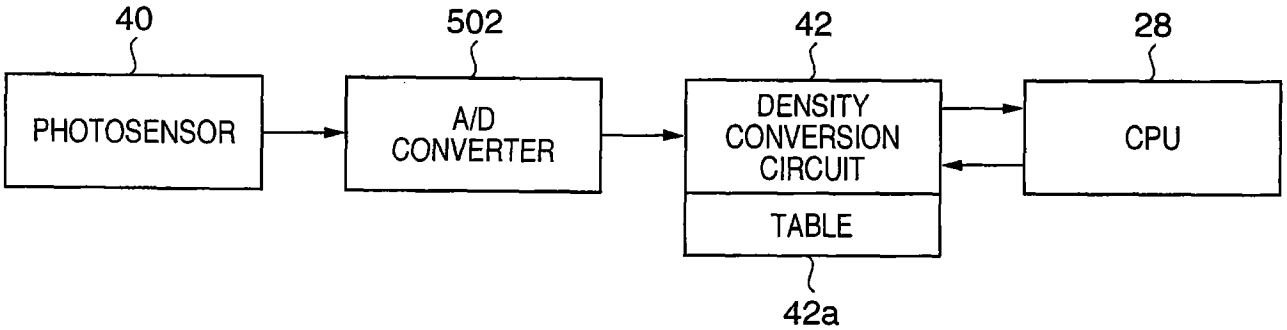
FIG. 14 is a block diagram for explaining a process to obtain an image density from a photosensor output signal.

[Photosensor Signal Process: FIG. 14]

FIG. 14 is a block diagram for explaining a process for a signal from the photosensor 40 which faces the photosensitive drum 4 and includes the LED 10 and photodiode 11.

The photosensor 40 converts, into an electrical signal, near-infrared light incident on the photosensor 40 from the photosensitive drum 4. The A/D converter 502 converts the electrical signal having an output voltage of 0 to 5 V into a digital signal of 0 to 255 levels. The density conversion circuit 42 converts the digital signal into a density. The photosensor 40 adopted in the first embodiment detects only regularly reflected light from the photosensitive drum 4.

Figure 15:
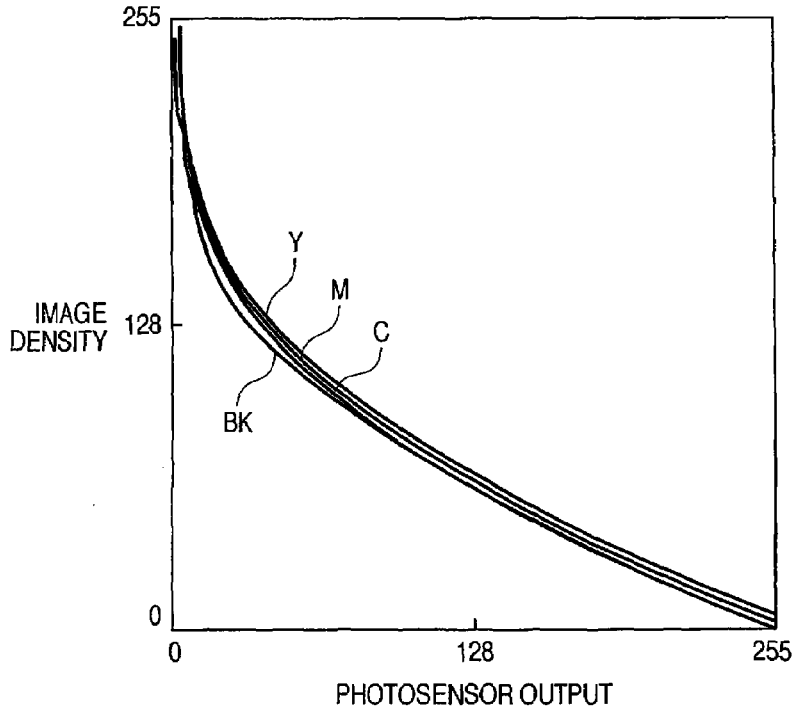
FIG. 15 is a graph showing the relationship between the photosensor output and the image density.

[Relationship Between Photosensor Output and Output Image Density: FIG. 15]

FIG. 15 is a graph showing a relationship between an output from the photosensor 40 and the output image density when the density on the photosensitive drum 4 is changed stepwise by area coverage modulation of each color.

In the first embodiment, an output from the photosensor 40 is set to 5 V, i.e., 255 levels when no toner attaches to the photosensitive drum 4. As is apparent from FIG. 15, as the area coverage of the photosensitive drum 4 by each toner increases, i.e., the image density increases, an output from the photosensor 40 decreases. From this characteristic, the density signal of each color can be read at high precision by preparing a table 42*a* for converting a signal output from a sensor dedicated to each color into a density signal.

[Calculation of Proper Contrast Potential: B in FIG. 13]

Figure 13:
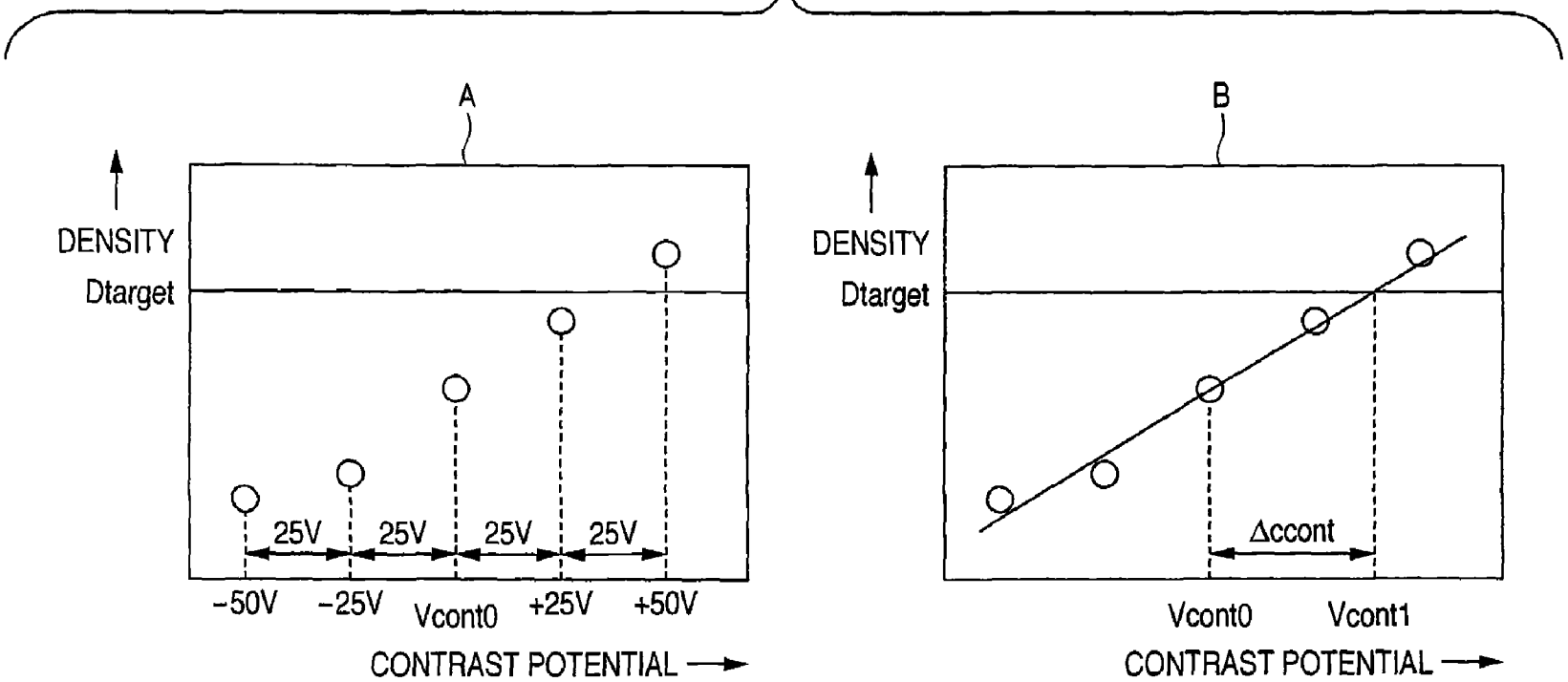
FIG. 13 shows graph A representing the relationship between a contrast potential for forming a toner patch and a detected image density, and graph B for explaining a method of calculating a contrast potential for obtaining a target image density (maximum density) on the basis of the relationship in A.

Toner patches are formed at five contrast potentials shown in A of FIG. 13, and the densities of the formed toner patches are detected as shown in FIG. 13. Then, as shown in B of FIG. 13, the five formed toner patches are detected by the photosensor 40 and converted into density signals, providing the relationship between the five contrast potentials and densities. The obtained five data are linearly approximated by the least squares method, as shown in B of FIG. 13, and a proper contrast potential Vcont1 corresponding to a desired target density Dtarget is calculated. The image forming apparatus 1000 can calculate the proper contrast potential Vcont1 exhibiting the maximum density (target density Dtarget).

<C. Tone Correction Control>

Tone correction control concerning stabilization of the image reproduction characteristic of the single image forming apparatus 1000 will be explained.

Figure 16:
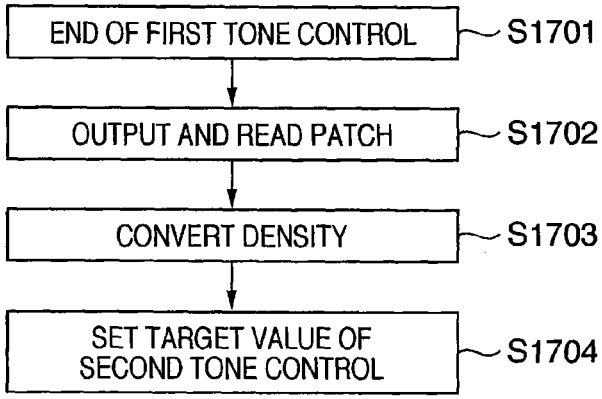
FIG. 16 is a flowchart showing a process to set the target value of the second tone control.

[Target Value Setting Process in Second Tone Control: FIG. 16]

FIG. 16 is a flowchart showing a process to set the target value of the second tone control.

This tone correction control is to stabilize an image by detecting a patch pattern density on the photosensitive drum 4, and correcting the LUT 25 created in the first tone control executed in advance using the reader section 1000A and the like. This tone correction control is called the second tone control.

The purpose of this tone correction control is to maintain stable color reproducibility achieved by the first tone control. Thus, a state immediately before the end of the first tone control is set as a target value. The CPU 28 executes the setting process for the target value of the second tone control in tone correction shown in FIG. 16 by controlling respective units using the RAM 32 as a work area on the basis of control programs stored in the ROM 30.

If the CPU 28 detects the end of the first tone control in step S1701, the process advances to step S1702. In step S1702, the CPU 28 forms M, Y, C, and K patch patterns on the photosensitive drum, and instructs the photosensor 40 to detect the formed patch patterns.

The process advances to step S1703 to convert the detected patch patterns into densities, and then to step S1704 to back up the obtained density values as the target values of the second tone control. The target values of the second tone control are updated every time the first tone control is done.

In the second tone control, the densities of patch patterns formed at a plurality of gray levels on the photosensitive drum 4 at an arbitrary timing, e.g., after power-on, during continuous image formation, or during post-rotation after the end of image formation are detected and used to correct a γLUT attained by the first tone control, as needed. At this time, the contrast potential setting is adjusted to one in normal image formation. Densities at a plurality of gray levels obtained by detecting patch patterns by the photosensor 40 are compared with the target densities of the second tone control that are stored after the first tone control. The LUT 25 can be corrected by multiplying it by a LUT created from the differences.

<D. Toner Density Control>

Toner density control (to be referred to as ATR hereinafter) in the image forming apparatus 1000 will be explained.

In the arrangement of the developing unit using a two-component developer containing a magnetic carrier and non-magnetic carrier, toner is gradually used and consumed for developing as the image formation operation continues. Resultantly, the ratio (to be referred to as T/D ratio hereinafter) of the toner amount to the total developer amount decreases. The image forming apparatus keeps the T/D ratio constant by newly refilling the developing unit with toner by a consumption calculated from an image signal or the like.

The image forming apparatus also executes the following control in order to keep the output image density constant. That is, when the developing unit has an initial T/D ratio, M, Y, C, and K patch patterns are formed in advance at a predetermined contrast potential and detected by the photosensor 40 to back up obtained density values as the target values of ATR control. The target values are updated every time the developing unit is newly exchanged.

The M, C, Y, and K patch patterns are formed on the photosensitive drum at the same contrast potential as the initial one at an arbitrary timing, e.g., after power-on, during image formation, or during post-rotation after the end of image formation. The photosensor 40 detects these patch patterns. Obtained density values are compared with the backup target values, and the toner refilling amounts are corrected from the differences. By executing this control, the toner refilling amounts are controlled to stabilize the T/D ratio in accordance with an actual output image density.

<Image Stabilization Control>

In a full-color image forming apparatus like the image forming apparatus according to the first embodiment, a variety of control processes (A to D described above: to be referred to as image stabilization control hereinafter) to obtain a high-quality image are desirably executed at predetermined timings in order to provide a stable image. Particularly when full-color images are successively output, the image stabilization control needs to be executed at an arbitrary timing, e.g., after power-on, during image formation, or after the end of image formation.

However, a full-color image forming apparatus mainly for office use is used for monochrome image output rather than full-color image output in many cases, and often requested to successively output many images. In this case, it is not preferable for the user to frequently execute the above-mentioned control during image formation or take a long rise time till the standby state after power-on.

In general, therefore, the necessary control contents and frequency of image stabilization control greatly differ between formation of a full-color image and formation of a monochrome image. This is because monochrome image output is single-color output, especially office documents contain binary images such as a text and thin line rather than halftone images, and user requests against variations in color tincture, density, and tonality are less dominant than those in full-color output. Hence, in monochrome image output, the execution interval of image stabilization control is set longer than that in full-color image output (the execution frequency is set lower).

Many users who mainly output monochrome images put importance on throughput. In this case, the wait time from power-on to the standby state in image stabilization control, the down time during continuous output, and the like are important factors.

The image forming apparatus according to the first embodiment can shorten the rise time from power-on to the standby state by adopting an arrangement capable of determining the type and timing of image stabilization control described above in accordance with a use log representing the use of the image forming apparatus by the user.

More specifically, according to the first embodiment, image formation use status information (use log) after activation of the apparatus including information on the ratio of monochrome outputs and full-color outputs, output sheet count information, and average image density information of output images is collected from an installed full-color image forming apparatus. The image forming apparatus stores the adjustment items of necessary image forming conditions in advance in a storage means for each use log. The adjustment items are the above-described image stabilization control types, i.e., potential control, maximum density control, tone correction control, and toner density control. Based on the collected information, the image forming apparatus can select a combination (adjustment items of necessary image forming conditions) of image stabilization control processes optimum for the use status of the image forming apparatus from the above-mentioned image stabilization control processes stored in the storage means. The image forming apparatus can change the items of image forming conditions adjusted upon activation or the like in accordance with the use status of the apparatus. When the output ratio of monochrome images is high and the output frequency of color images is low, the image forming apparatus can shorten the rise time by skipping the time of adjustment upon power-on to maintain color output images at high quality.

In addition to the above-mentioned image stabilization control processes A to D, this arrangement includes (E) transfer condition optimization control, (F) forced developer discharge control, and (G) black band forming control. (F) forced developer discharge control is to discharge degraded toner from a developing unit using a two-component developer when low-density images are formed successively. (G) black band forming control is to apply toner into a band shape and use it as a lubricant for the cleaner.

Figure 17:
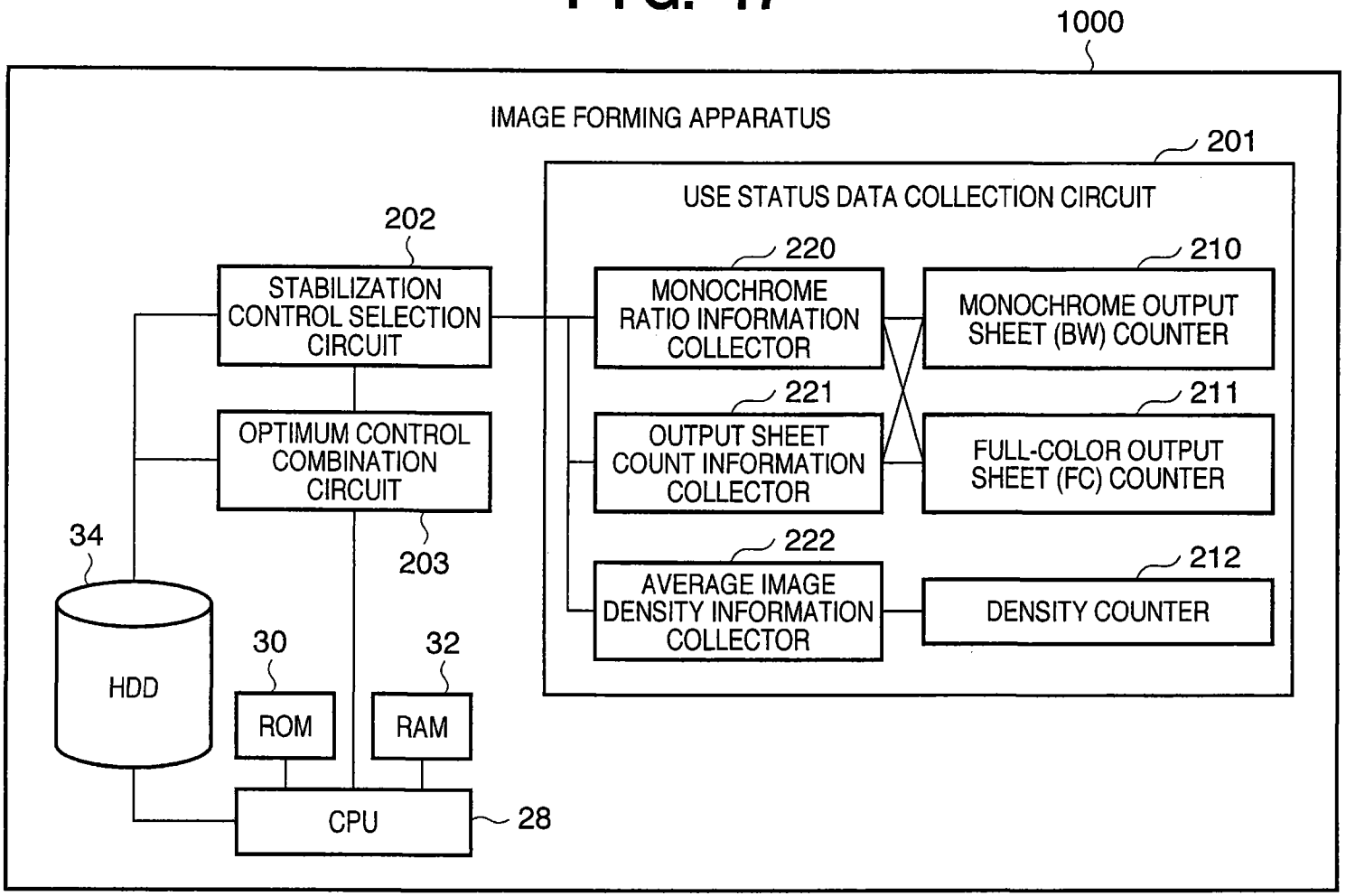
FIG. 17 is a block diagram showing a control arrangement to determine a control pattern (adjustment items of image forming conditions) optimum for image stabilization on the basis of the use log in the image forming apparatus according to the first embodiment.
Figure 18:
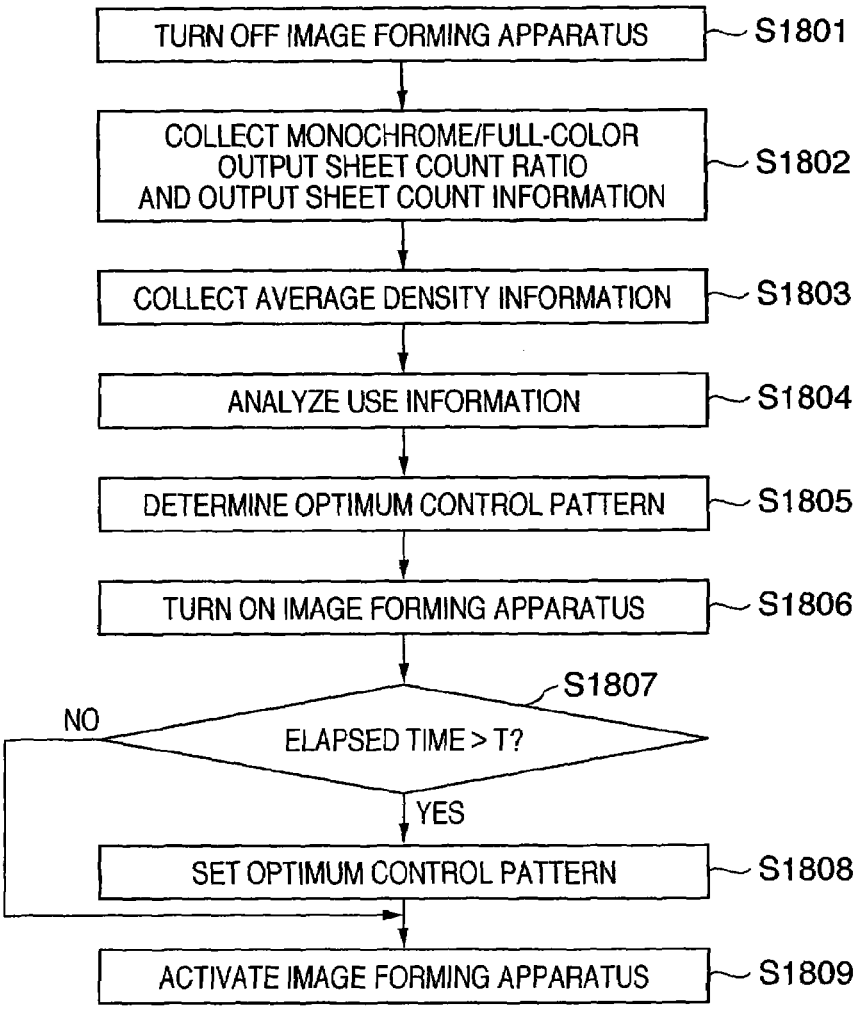
FIG. 18 is a flowchart showing a process to determine a control pattern (adjustment items of image forming conditions) optimum for image stabilization on the basis of the use log in the image forming apparatus according to the first embodiment.

[Setting of Optimum Control Pattern: FIGS. 17 and 18]

A process to select and set a control pattern (adjustment items of image forming conditions) optimum for image stabilization on the basis of the use log in the image forming apparatus will be described with reference to FIGS. 17 and 18.

FIG. 17 is a block diagram showing a control arrangement to determine a control pattern (adjustment items of image forming conditions) optimum for image stabilization on the basis of the use log in the image forming apparatus. In FIG. 17, building components are represented as hardware components such as "circuit", but "circuit" and the like may be implemented by software, as shown in FIG. 3. FIG. 18 is a flowchart showing the process to determine a control pattern (adjustment items of image forming conditions) optimum for image stabilization on the basis of the use log in the image forming apparatus.

The CPU 28 executes the process in FIG. 18 by controlling respective units using the RAM 32 as a work area on the basis of control programs stored in the ROM 30.

If the image forming apparatus 1000 is turned off in step S1801, the process advances to step S1802. In step S1802, a monochrome ratio collector 220 collects and calculates the ratio of the monochrome output sheet count to the total output sheet count from a monochrome output sheet counter 210 and full-color output sheet counter 211 in a use status data collection circuit 201. An output sheet count information collector 221 collects and calculates an output sheet count after previous power-on from the monochrome output sheet counter 210 and full-color output sheet counter 211 in the use status data collection circuit 201.

The process advances to step S1803, and an average image density collector 222 collects and calculates the average image density per output image from a density counter 212 in the use status data collection circuit 201. The density counter 212 accumulates the densities of all output images.

The monochrome output sheet counter 210, full-color output sheet counter 211, and density counter 212 correspond to the counter value storage area 310 in FIG. 3. The monochrome ratio information collector 220, the output sheet count information collector 221 for an output sheet count after previous power-on, and the average image density information collector 222 for an output image correspond to the collected information storage area 311 in FIG. 3.

The process advances to step S1804, and a stabilization control selection circuit 202 analyzes the pieces of use status information of the image forming apparatus obtained from the collectors 220 to 222. Thereafter, the process advances to step S1805.

In step S1805, an optimum control combination circuit 203 determines an optimum control pattern by combining selected control parts (image stabilization control processes).

Figure 19:
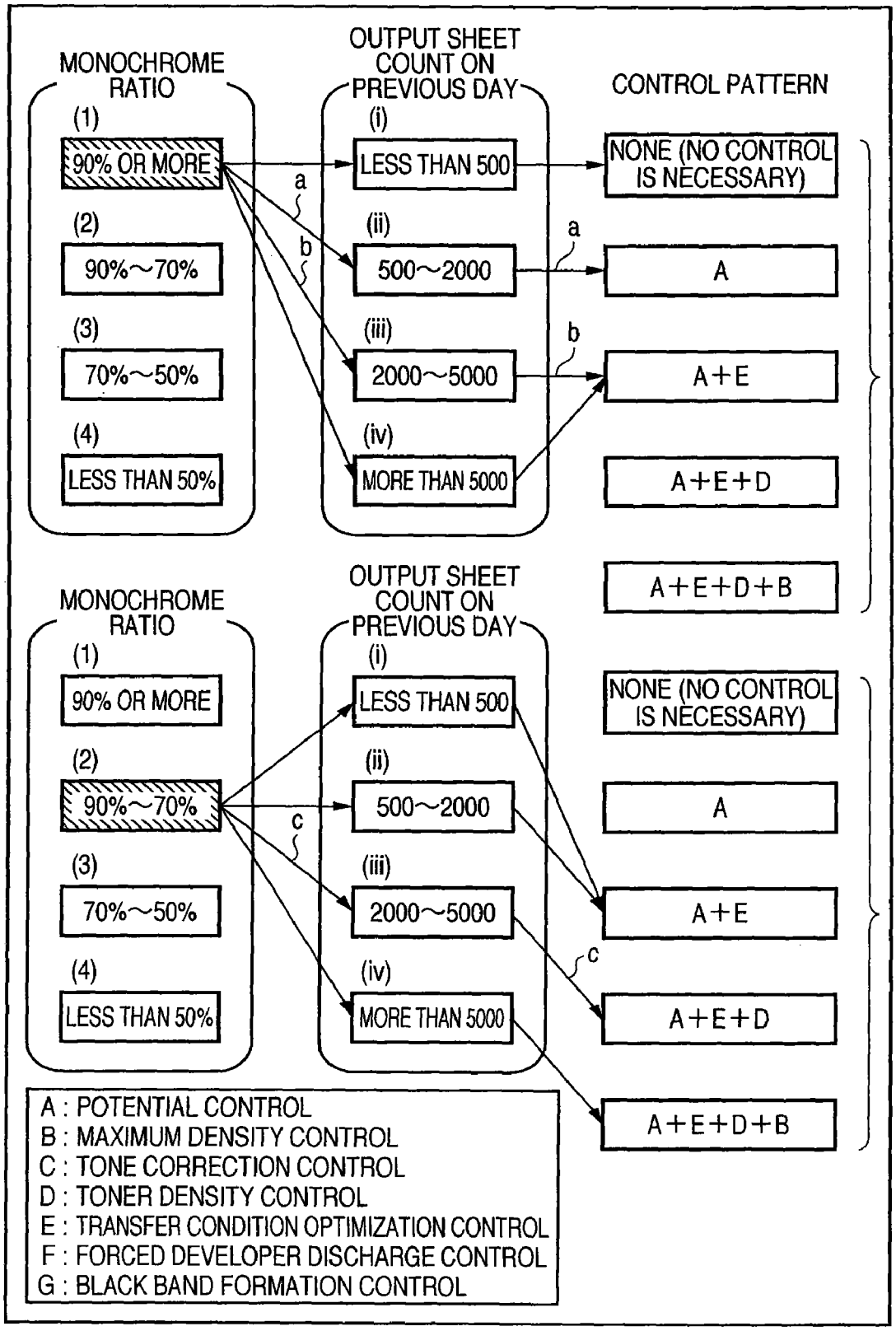
FIG. 19 is a conceptual view showing selection of an optimum control pattern on the basis of each use log (combination of the monochrome ratio and total output sheet count)
Figure 20:
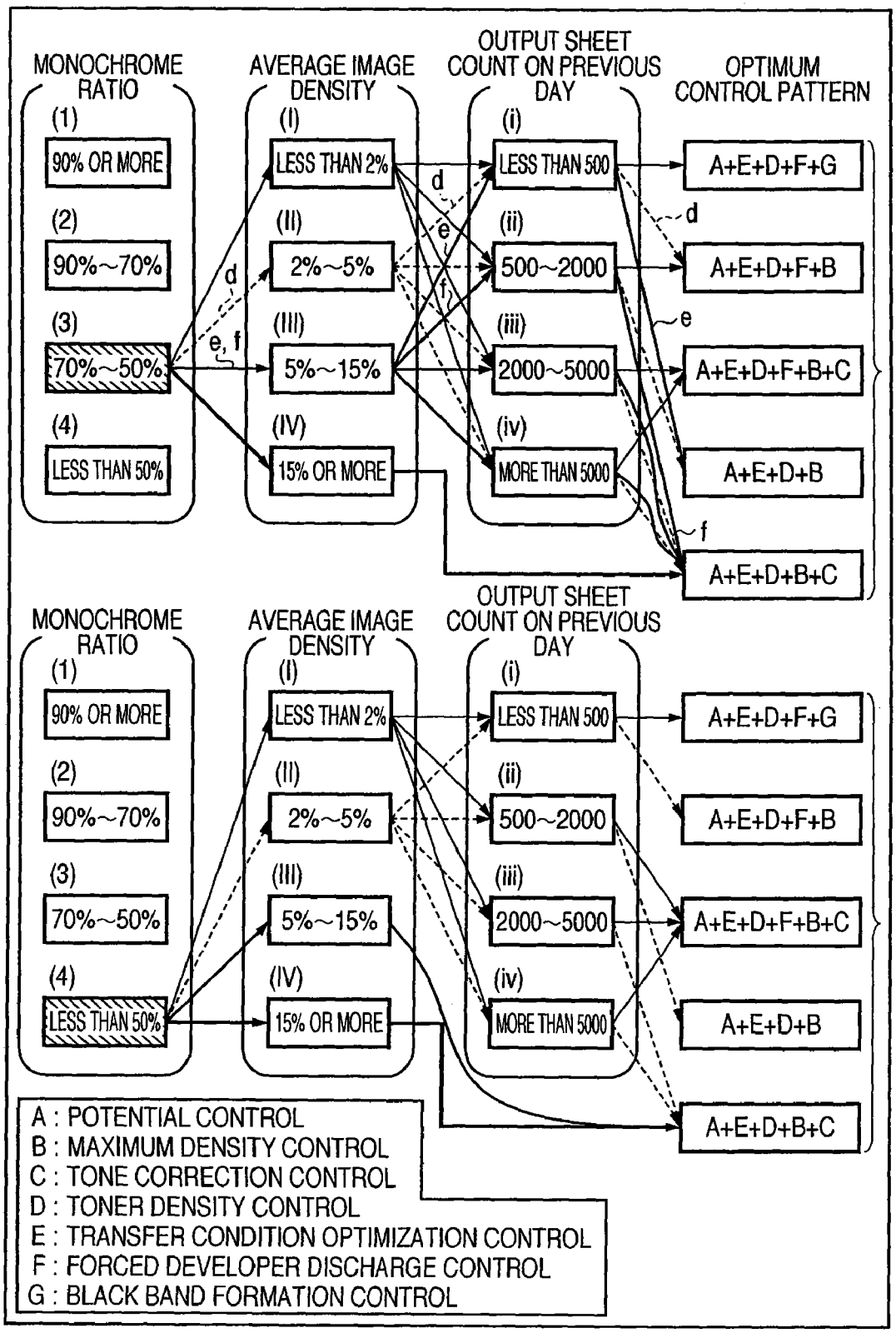
FIG. 20 is a conceptual view showing selection of an optimum control pattern on the basis of each use log (combination of the monochrome ratio, average image density, and total output sheet count)

(Stabilization Control Selection Circuit and Optimum Control Combination Circuit: FIGS. 19 and 20)

A concrete method of determining an optimum control pattern from each use log by the above-mentioned stabilization control selection circuit 202 and optimum control combination circuit 203 will be described with reference to FIGS. 19 and 20.

The first embodiment considers, as the use log, the monochrome image ratio and the cumulative density of all images formed after activation. The cumulative density of all images is represented by the total output sheet count when the monochrome ratio is 70% or more (see FIG. 19), and the combination of the average image density and total output sheet count when the monochrome ratio is lower than 70% (see FIG. 20).

FIG. 19 is a conceptual view showing selection of an optimum control pattern on the basis of each use log (combination of the monochrome ratio and total output sheet count). FIG. 20 is a conceptual view showing selection of an optimum control pattern on the basis of each use log (combination of the monochrome ratio, average image density, and total output sheet count).

In the first embodiment, as shown in an example of FIG. 19, pieces of monochrome/full-color output sheet count ratio information 220 are classified into the following four categories:

(1) monochrome ratio: 90% or more (2) monochrome ratio: 70% (inclusive) to 90% (exclusive)

(3) monochrome ratio: 50% (inclusive) to 70% (exclusive)

(4) monochrome ratio: less than 50%

Pieces of output sheet count information 221 after previous power-on are classified into the following four categories:

(i) output sheet count on the previous day: less than 500 sheets (ii) output sheet count on the previous day: 500 sheets (inclusive) to 2,000 sheets (exclusive)

(iii) output sheet count on the previous day: 2,000 sheets (inclusive) to 5,000 sheets (exclusive)

(iv) output sheet count on the previous day: 5,000 sheets or more

In the first embodiment, if the monochrome ratio is (1) or (2), a control pattern upon power-on is determined from a combination with the output sheet count on the previous day.

More specifically, when the monochrome ratio is (1) or (2), an optimum control pattern is selected from five control patterns on the basis of combinations of (1) and (2), and (i) to (iv), as shown in FIG. 19. The five control patterns are none (no control is necessary), A (potential control), A+E (potential control+transfer condition optimization), A+E+D (potential control+transfer condition optimization+toner density control), and A+E+D+B (potential control+transfer condition optimization+toner density control+maximum density control).

An example of selecting an optimum control pattern will be explained with reference to arrows a to c in FIG. 19. Arrow a in FIG. 19 indicates a case where the monochrome ratio is (1) 90% or more and the output sheet count on the previous day is (ii) 500 sheets (inclusive) to 2,000 sheets (exclusive). When the monochrome ratio is as high as 90% or more and the output sheet count on the previous day is 500 sheets (inclusive) to 2,000 sheets (exclusive), it suffices to confirm only potential variations and execute necessary adjustment. Hence, a pattern to execute only (A) potential control is selected.

Arrow b in FIG. 19 indicates a case where the monochrome ratio is (1) 90% or more, similar to arrow a in FIG. 19, and the output sheet count on the previous day is as slightly large as (iii) 2,000 sheets (inclusive) to 5,000 sheets (exclusive). When the monochrome ratio is as high as 90% or more and the output sheet count on the previous day is as slightly large as 2,000 sheets (inclusive) to 5,000 sheets (exclusive), it is sufficient to perform only (A) potential control and (E) transfer condition optimization. Hence, a pattern to execute only (A) potential control and (E) transfer condition optimization is selected.

Arrow c in FIG. 19 indicates a case where the monochrome ratio is 70% (inclusive) to 90% (exclusive) and the color ratio rises slightly. In this case, the output sheet count on the previous day is (iii) 2,000 sheets (inclusive) to 5,000 sheets (exclusive), similar to arrow b in FIG. 19. When the monochrome ratio is 70% (inclusive) to 90% (exclusive), the color ratio rises slightly, and the output sheet count on the previous day is as slightly large as 2,000 sheets (inclusive) to 5,000 sheets (exclusive), (D) toner density control is performed in addition to (A) potential control and (E) transfer condition optimization. As a result, a pattern to execute only (A) potential control, (E) transfer condition optimization, and (D) toner density control is selected. As shown in FIG. 19, even for another combination of the monochrome ratio and the output sheet count on the previous day, one of the five control patterns shown in FIG. 19 is selected.

When the monochrome ratio is (3) or (4) in FIG. 19, i.e., the full-color output ratio is slightly high, the average image density information 222 for output images is considered as shown in FIG. 20. FIG. 20 is a conceptual view showing selection of an optimum control pattern on the basis of each use log (combination of the monochrome ratio, average image density, and total output sheet count).

Pieces of average image density information 222 for output images are classified into the following four categories:

(I) average image density: less than 2%

(II) average image density: 2% (inclusive) to 5% (exclusive)

(III) average image density: 5% (inclusive) to 15% (exclusive)

(IV) average image density: 15% or more

If the monochrome ratio is (3) or (4), a control pattern in next power-on is determined from the combination of the average image density of output images and the output sheet count after previous power-on.

In this case, an optimum pattern is selected from five control patterns on the basis of combinations of (3) and (4), (I) to (IV), and (i) to (iv), as shown in FIG. 20. The five control patterns are A+E+D+F+G, A+E+D+F+B, A+E+D+F+B+C, A+E+D+B, and A+E+D+B+C. A is potential control, B is maximum density control, C is tone correction control, D is toner density control, E is transfer condition optimization control, F is forced developer discharge control, and G is black band forming control.

An example of selecting an optimum control pattern will be explained with reference to arrows d to f in FIG. 20.

Arrow d in FIG. 20 indicates a case where the monochrome ratio is (3) 50% (inclusive) to 70% (exclusive) and the color ratio rises. When the monochrome ratio is (3) 50% (inclusive) to 70% (exclusive) and the color ratio rises, the average image density of output images is also referred to in addition to the output sheet count. When the average image density is (II) 2% (inclusive) to 5% (exclusive) and the output sheet count on the previous day is (i) less than 500 sheets, (D) toner density control for high color ratio, (F) forced developer discharge for low average image density and small output sheet count, and (G) black band formation to provide a lubricant for a cleaner need to be executed in addition to (A) potential control and (E) transfer condition optimization. Thus, a pattern to execute (D) toner density control, (F) forced developer discharge, and (G) black band formation in addition to (A) potential control and (E) transfer condition optimization is selected.

Arrow e in FIG. 20 indicates a case where the monochrome ratio is (3) 50% (inclusive) to 70% (exclusive), similar to arrow d in FIG. 20, the output sheet count on the previous day is also similarly (i) less than 500 sheets, but the average image density is as slightly high as (III) 5% (inclusive) to 15% (exclusive). In this case, (D) toner density control and (B) maximum density control need to be executed in addition to (A) potential control and (E) transfer condition optimization. Hence, a pattern to execute (D) toner density control and (B) maximum density control in addition to (A) potential control and (E) transfer condition optimization is selected.

Arrow f in FIG. 20 indicates a case where the monochrome ratio is (3) 50% (inclusive) to 70% (exclusive), the average image density is (III) 5% (inclusive) to 15% (exclusive), and the output sheet count on the previous day is (ii) 500 sheets (inclusive) to 2,000 sheets (exclusive). In this case, the control pattern (A+E+D+B+C) obtained by adding (C) tone correction control to the control pattern (A+E+D+B) selected by arrow e in FIG. 20 is selected. As shown in FIG. 20, even for another combination of the monochrome ratio, the average image density, and the output sheet count on the previous day, one of the five control patterns shown in FIG. 20 is selected.

Referring back to the flowchart of FIG. 18, the process advances to step S1806. If the image forming apparatus 1000 is turned on in step S1806, the process advances to step S1807 to determine whether the elapsed time after previous power-off is longer than a predetermined time T. At this time, the elapsed time during which the image forming apparatus 1000 is OFF may be measured or calculated from a temperature drop of the fixing unit 7.

If the power-off time is longer than the predetermined time T in step S1807, the process advances to step S1808 to set the optimum control pattern determined in step S1805 as control of the image forming apparatus 1000 upon activation. Then, the process advances to step S1809 to activate the image forming apparatus.

If the power-off time is equal to or shorter than the predetermined time T in step S1807, the process advances to step S1809 to inhibit control using the optimum control pattern upon activation.

As described above, the image forming apparatus can change the items of image forming conditions adjusted upon activation or the like on the basis of use status information including the monochrome/full-color output ratio information, output sheet count information, and average image density information of output images. That is, the image forming apparatus can select an optimum control pattern in accordance with the use status of the apparatus from a plurality of image stabilization control processes stored in advance.

The first embodiment has described the arrangement associated with image stabilization control till the standby state after power-on. The same arrangement can also apply to time shortening and optimization of image stabilization control which interrupts continuous output and is accompanied by the down time, and image stabilization control executed during post-rotation after the end of image formation.

An optimum control combination dependent on the environment characteristic and standing characteristic can be selected by referring to, e.g., an output from the environmental sensor 33 arranged in the image forming apparatus, and the standing time after previous image formation on the basis of a timer arranged in the main body or temperature information of the fixing unit 7.

Image stabilization control according to the first embodiment is optimized on the basis of the past use log of the image forming apparatus. Thus, the image forming apparatus can be optimized without any cumbersome work by a serviceman, maintenance personnel, or user, unlike the conventional practice.

Second Embodiment

The second embodiment will be described. An image forming apparatus in the second embodiment is similar to that in the first embodiment. Only differences of the image forming apparatus in the second embodiment from that in the first embodiment will be described, and a description of common parts will not be repeated.

[Features]

The second embodiment is directed to an image forming system in which an image forming apparatus and host computer are connected to each other via a communication line. The image forming apparatus can acquire the use log, i.e., use status information (the monochrome image ratio out of monochrome and color images formed after previous adjustment of image forming conditions, the total number of images, and the average image density of all images) described in the first embodiment. The host computer can store the adjustment items of necessary image forming conditions in a storage means in correspondence with each use log described in the first embodiment. Use status information acquired by the image forming apparatus is transmitted to the host computer via the communication line. Based on the transmitted use status information, the host computer determines a combination of image stabilization control processes optimum for the image forming apparatus, and sends it back to the image forming apparatus via the communication line. With this arrangement, the image forming system can change the items of image forming conditions adjusted upon activation of the image forming apparatus or the like in accordance with the use status of each apparatus. When the output ratio of monochrome images is high and the output frequency of color images is low in the office or the like, the image forming system can shorten the time of adjustment upon power-on to maintain color output images at high quality. The image forming system according to the second embodiment will be explained below with reference to FIGS. 21 and 22.

Figure 21:
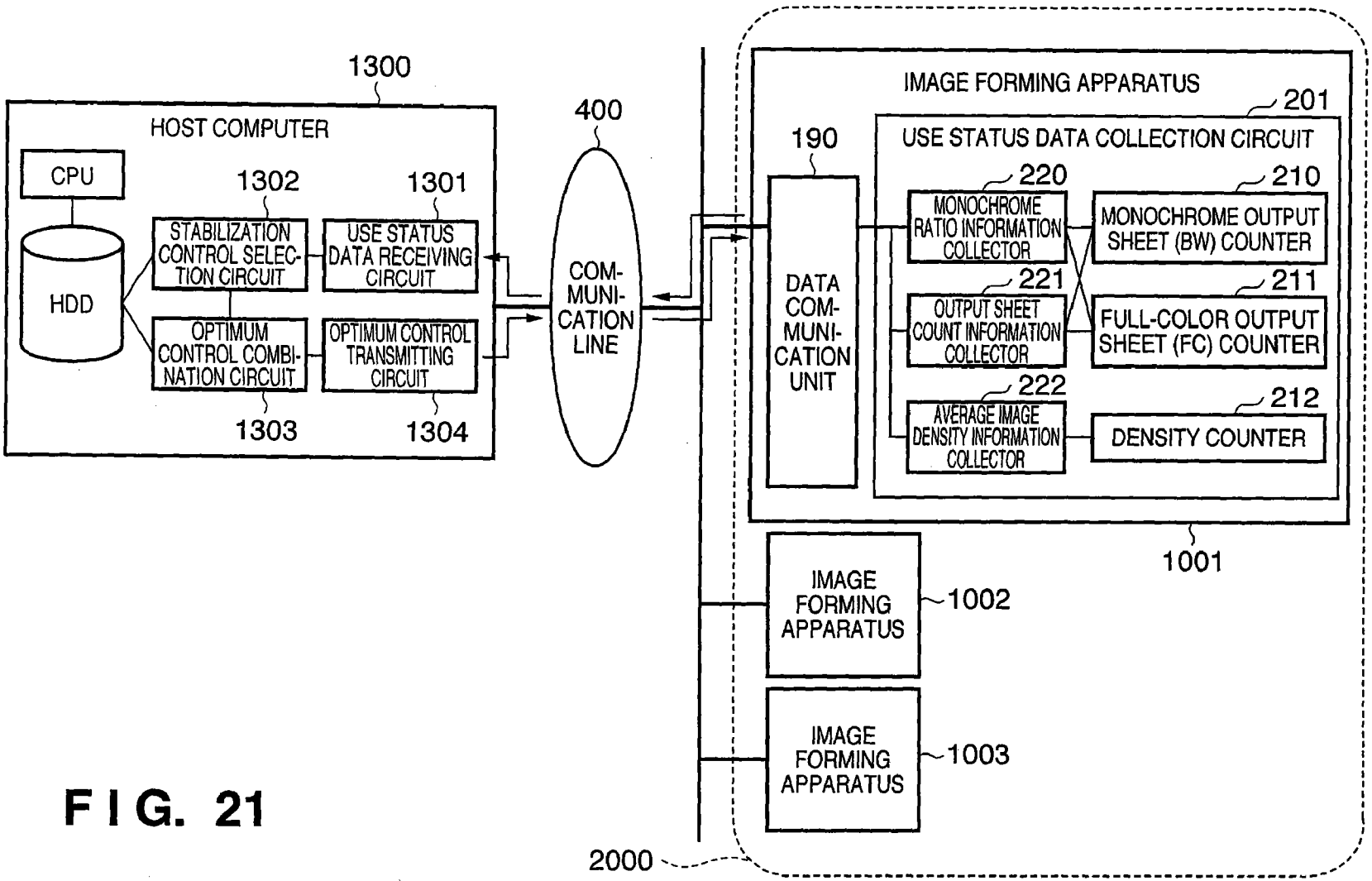
FIG. 21 is a block diagram showing a control arrangement to determine a control pattern (adjustment items of image forming conditions) optimum for image stabilization on the basis of the use log of an image forming apparatus in an image forming system according to the second embodiment.

[Overall Arrangement of Image Forming System: FIG. 21]

FIG. 21 is a block diagram showing the control arrangement of the image forming system which determines a control pattern (adjustment items of image forming conditions) optimum for image stabilization on the basis of the use log of the image forming apparatus.

In the second embodiment, the image forming system comprises an image forming apparatus group 2000 of image forming apparatuses installed in the office or the like, and a host computer 300 which is connected to the image forming apparatus group 2000 via a network and manages it. The arrangement of the image forming part of a typical image forming apparatus 1001 in the image forming apparatus group 2000 is similar to the arrangement of the image forming apparatus 1000 described in the first embodiment, and a description thereof will not be repeated. The image forming apparatus 1001 further comprises a data communication unit 190, and is connected to the host computer 300 via the data communication unit 190 and a communication line 400.

The image forming apparatus 1001 can acquire the use log, i.e., use status information (the monochrome image ratio out of monochrome and color images formed after previous adjustment of image forming conditions, the total number of images, and the average image density of all images) described in the first embodiment. The host computer 300 can store the adjustment items of necessary image forming conditions in a storage means in correspondence with each use log described in the first embodiment.

Use status information acquired by the image forming apparatus 1001 is transmitted to the host computer 300 via the communication line. Based on the transmitted use status information, the host computer 300 can determine a combination of image stabilization control processes optimum for the image forming apparatus 1001, and send it back to the image forming apparatus 1001 via the communication line.

Figure 22:
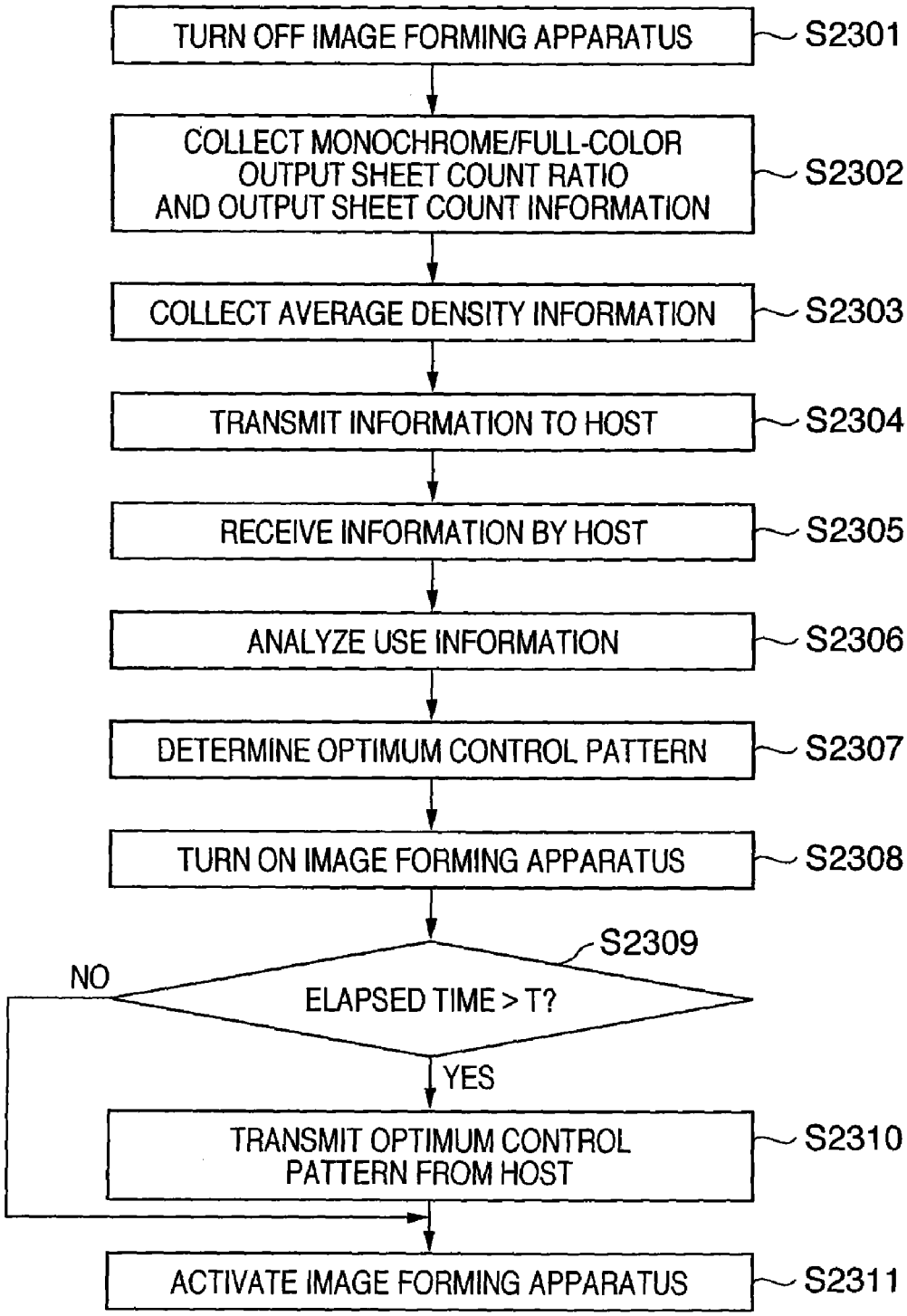
FIG. 22 is a flowchart showing a process to determine a control pattern (adjustment items of image forming conditions) optimum for image stabilization on the basis of the use log of the image forming apparatus in the image forming system according to the second embodiment.

[Setting of Optimum Control Pattern: FIG. 22]

FIG. 22 is a flowchart showing a process to select a control pattern (adjustment items of image forming conditions) optimum for image stabilization on the basis of the use log of the image forming apparatus, and transmit the selected control pattern in the image forming system.

A CPU 28 executes the process in FIG. 22 by controlling respective units using a RAM 32 as a work area on the basis of control programs stored in a ROM 30.

If the image forming apparatus 1001 is turned off in step S2301, the process advances to step S2302. In step S2302, a use status data collection circuit 201 collects monochrome/full-color output sheet count ratio information 220 and output sheet count information 221 after previous power-on from a monochrome output sheet counter 210 and full-color output sheet counter 211.

The process advances to step S2303, and the use status data collection circuit 201 collects average image density information 222 for output images from a density counter 212 in the use status data collection circuit 201.

The process advances to step S2304, and the image forming apparatus 1001 transmits the collected pieces of use status information 220 to 222 to the host computer 300 via the data communication unit 190 and communication line 400.

In step S2305, a use status data receiving circuit 1301 in the host computer 1300 receives the transmitted use status information. The process advances to step S2306, and a stabilization control selection circuit 1302 analyzes the obtained pieces of use status information 220 to 222.

In step S2307, an optimum control combination circuit 1303 creates an optimum control pattern by combining selected control parts. The procedures executed by the stabilization control selection circuit 1302 and optimum control combination circuit 1303 on the basis of the pieces of use status information 220 to 222 are the same as those described in the first embodiment with reference to the conceptual views of FIGS. 19 and 20.

If the image forming apparatus 1001 is turned on in step S2308, the process advances to step S2309 to determine whether the elapsed time after previous power-off is longer than a predetermined time T. At this time, the elapsed time during which the image forming apparatus 1001 is OFF may be measured or calculated from a temperature drop of a fixing unit 7.

If the power-off time is longer than the predetermined time T in step S2309, the process advances to step S2310. In step S2310, an optimum control transmitting circuit 304 transmits the optimum control pattern determined in step S2307 as control of the image forming apparatus 1001 upon activation via the communication line 400.

If the power-off time is equal to or shorter than the predetermined time T in step S2309, the process advances to step S2311 to inhibit transmission of the control pattern to the image forming apparatus 1001.

According to the second embodiment, the host computer 300 manages all pieces of latest use status information of respective image forming apparatuses, and also accumulates their pieces of past use status information. When a serviceman or maintenance personnel wants to refer to the use status of an image forming apparatus, he need not check each image forming apparatus, resulting in a short maintenance time and low maintenance cost.

As described above, in the image forming system according to the second embodiment, each network-connected image forming apparatus transmits use status information (monochrome/full-color output ratio information, output sheet count information, and average image density information of output images) to a network-connected host computer. Then, the host computer determines a combination of image signal control processes optimum for the image forming apparatus among a plurality of image signal control processes stored in advance in the host computer. The image forming system can, therefore, select an optimum control pattern in accordance with the use status of a user's image forming apparatus. Since the host computer manages the use log of each image forming apparatus, a short maintenance time and low maintenance cost can be achieved.

Other Embodiments

The object of the present invention is also achieved by supplying a storage medium which stores software program codes for implementing the functions of the above-described embodiments to a system or apparatus. In this case, the computer (or the CPU or MPU) of the system or apparatus reads out and executes the program codes stored in the storage medium.

In this case, the program codes read out from the storage medium implement the functions of the above-described embodiments, and the program codes and the storage medium which stores the program codes constitute the present invention.

The storage medium for supplying the program codes includes a Floppy® disk, hard disk, magnetooptical disk, CD-ROM, CD-R, and CD-RW. The storage medium also includes a DVD-ROM, DVD-RAM, DVD-RW, DVD+RW, magnetic tape, nonvolatile memory card, and ROM. The program codes may also be downloaded via a network.

The functions of the above-described embodiments are implemented by executing the readout program codes by the computer. Also, the present invention includes a case where an OS (Operating System) or the like running on the computer performs some or all of actual processes on the basis of the instructions of the program codes and thereby implements the functions of the above-described embodiments.

Furthermore, the present invention includes a case where the functions of the above-described embodiments are implemented as follows. That is, the program codes read out from the storage medium are written in the memory of a function expansion board inserted into the computer or the memory of a function expansion unit connected to the computer. After that, the CPU of the function expansion board or function expansion unit performs some or all of actual processes on the basis of the instructions of the program codes.

In this case, the program is supplied directly from the storage medium which stores the program, or downloaded from another computer, database, or the like (not shown) connected to the Internet, a commercial network, a local area network, or the like.

The embodiments have exemplified an electrophotographic image forming apparatus. However, the present invention is not limited to electrophotographic printing, and can also be applied to a variety of printing methods such as inkjet printing, thermal transfer printing, thermal printing, electrostatic printing, and electrosensitive printing.

The program may take the form of an object code, a program code executed by an interpreter, script data supplied to the OS (Operating System), or the like.

The present invention can provide a color image forming apparatus and information processing apparatus capable of shortening the adjustment time of image forming conditions in accordance with the use status of each apparatus without degrading the image quality, and a control method therefor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-261412, filed Sep. 26, 2006, which is hereby incorporated by reference herein in its entirety.

What is claimed is:

1. An image forming apparatus comprising:

an image forming unit adapted to form an image;

a storage unit adapted to store information indicating a relation between a ratio of monochrome image formation in image formation by the image forming unit, and a plurality of adjustment operations;

a selection unit adapted to select at least one adjustment operation from the plurality of adjustment operations stored in the storage unit in accordance with the ratio of monochrome image formation; and an adjustment unit adapted to, when activating the image forming apparatus, perform the at least one adjustment operation selected by the selection unit to adjust the image forming unit.

2. The apparatus according to claim 1, wherein the storage unit stores density information of images formed by the image forming unit, and the selection unit selects the at least one adjustment operation in accordance with the ratio of monochrome image formation and the density information.

3. The apparatus according to claim 2, wherein when the ratio of monochrome image formation is not lower than a predetermined value, the density information is a cumulative density of images formed by the image forming unit that is stored in the storage unit.

4. The apparatus according to claim 2, wherein when the ratio of monochrome image formation is lower than a predetermined value, the density information is an average image density of images formed by the image forming unit that is stored in the storage unit.

5. The apparatus according to claim 1, wherein the plurality of adjustment operations includes at least two of potential control, maximum density control, tone correction control, toner density control, transfer condition optimization control, forced developer discharge control, and black band image forming control.

6. The apparatus according to claim 1, wherein the plurality of adjustment operations stored in the storage unit are combined into a plurality of control patterns, wherein each control pattern includes at least one of the plurality of adjustment operations, wherein each control pattern contains a different combination of adjustment operations, and wherein the selection unit selects the at least one adjustment operation by selecting one of the plurality of control patterns.

7. The apparatus according to claim 1, wherein the plurality of adjustment operations includes potential control.

8. The apparatus according to claim 1, wherein the plurality of adjustment operations includes maximum density control.

9. The apparatus according to claim 1, wherein the plurality of adjustment operations includes tone correction control.

10. The apparatus according to claim 1, wherein the plurality of adjustment operations includes toner density control.

11. The apparatus according to claim 1, wherein the plurality of adjustment operations includes transfer condition optimization control.

12. The apparatus according to claim 1, wherein the plurality of adjustment operations includes forced developer discharge control.

13. The apparatus according to claim 1, wherein the plurality of adjustment operations includes black band image forming control.

14. The apparatus according to claim 1, wherein the plurality of adjustment operations includes no control.

15. The apparatus according to claim 1, wherein the plurality of adjustment operations further includes no control.

16. An image forming apparatus comprising:

an image forming unit adapted to form an image;

a storage unit adapted to store information indicating relation between a ratio of monochrome image formation in image formation by the image forming unit, density information of images formed by the image forming unit, and a plurality of adjustment operations;

a selection unit adapted to select at least one adjustment operation from the plurality of adjustment operations stored in the storage unit in accordance with the ratio of monochrome formation and the density information; and an adjustment unit adapted to, when adjusting the image forming unit, perform the at least one adjustment operation selected by the selection unit to adjust the image forming unit.

17. The apparatus according to claim 16, wherein when the ratio of monochrome image formation is not lower than a predetermined value, the density information is a cumulative density of images formed by the image forming unit that is stored in the storage unit.

18. The apparatus according to claim 16, wherein when the ratio of monochrome image formation is lower than a predetermined value, the density information is an average image density of images formed by the image forming unit that is stored in the storage unit.

19. The apparatus according to claim 16, wherein the plurality of adjustment operations includes at least two of potential control, maximum density control, tone correction control, toner density control, transfer condition optimization control, forced developer discharge control, and black band image forming control.

20. The apparatus according to claim 16, wherein the plurality of adjustment operations stored in the storage unit are combined into a plurality of control patterns, wherein each control pattern includes at least one of the plurality of adjustment operations, wherein each control pattern contains a different combination of adjustment operations, and wherein the selection unit selects the at least one adjustment operation by selecting one of the plurality of control patterns.

* * * * *